US006751815B2

(12) United States Patent
Heimbrock et al.

(10) Patent No.: US 6,751,815 B2
(45) Date of Patent: Jun. 22, 2004

(54) CONVERTIBLE STRETCHER

(75) Inventors: Richard H. Heimbrock, Cincinnati, OH (US); Donald E. Smith, Greensburg, IN (US); Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 10/633,823

(22) Filed: Aug. 4, 2003

(65) Prior Publication Data

US 2004/0025253 A1 Feb. 12, 2004

Related U.S. Application Data

(62) Division of application No. 10/201,144, filed on Jul. 23, 2002, now Pat. No. 6,640,361, which is a division of application No. 09/482,367, filed on Jan. 13, 2000, now Pat. No. 6,446,283.

(60) Provisional application No. 60/116,826, filed on Jan. 22, 1999, and provisional application No. 60/132,930, filed on May 6, 1999.

(51) Int. Cl.[7] ..... A47C 21/08

(52) U.S. Cl. ..... 5/53.1; 5/424

(58) Field of Search ..... 5/53.1, 53.2, 178, 5/424

(56) References Cited

U.S. PATENT DOCUMENTS

| | | | | | |
|---|---|---|---|---|---|
| 239,664 | A | | 4/1881 | Nash | 297/19 |
| 299,670 | A | | 6/1884 | Nash | 297/19 |
| 354,579 | A | | 12/1886 | Pfeiffer | 5/626 |
| 594,846 | A | * | 12/1897 | Bennett | 5/618 |
| 694,353 | A | | 3/1902 | Clifton | 5/116 |
| 754,140 | A | * | 3/1904 | Hollis | 5/100 |
| 822,328 | A | * | 6/1906 | Welch | 5/178 |
| 984,374 | A | | 2/1911 | Jardin | 5/154 |
| 1,344,088 | A | | 6/1920 | Lundbom | 5/626 |
| 1,464,661 | A | * | 8/1923 | Plondke | 5/53.1 |
| 1,640,754 | A | * | 8/1927 | Covey | 5/183 |
| 1,884,552 | A | | 10/1932 | Bradley | 5/100 |
| 1,885,812 | A | * | 11/1932 | Fichtenbaum | 5/12.2 |
| 1,900,478 | A | | 3/1933 | Zimmermann | 5/100 |
| 1,907,298 | A | | 5/1933 | Kroll | 5/100 |
| 2,478,028 | A | | 8/1949 | Travis | 5/100 |
| 2,666,213 | A | * | 1/1954 | Bash | 5/131 |
| 2,724,127 | A | * | 11/1955 | Trivas et al. | 5/53.1 |
| 2,799,869 | A | | 7/1957 | Leone et al. | 5/430 |
| 2,871,490 | A | | 2/1959 | Balonick | 5/430 |
| 2,976,548 | A | | 3/1961 | Maertins | 5/430 |
| 3,012,253 | A | | 12/1961 | Hamilton | 5/100 |

(List continued on next page.)

FOREIGN PATENT DOCUMENTS

| | | | |
|---|---|---|---|
| CA | 1031505 | 5/1978 | |
| DE | 1954076 | 5/1971 | 5/100 |
| DE | 3510707 | 10/1986 | 5/425 |
| GB | 430276 | 6/1935 | |
| GB | 637951 | 5/1950 | 5/100 |
| GB | 1094692 | 12/1967 | |
| WO | WO 98/58570 | 12/1998 | |

*Primary Examiner*—Robert G. Santos
(74) *Attorney, Agent, or Firm*—Barnes & Thornburg

(57) ABSTRACT

A hospital stretcher includes a patient support deck having an upwardly-facing patient support surface, and at least one sideframe adjacent to a first side of the stretcher, and movable between (i) a first raised position where the top of the at least one sideframe is generally disposed above the patient support surface at a first adult patient-restraining height, (ii) a second fully-raised position where the top of the at least one sideframe is generally disposed above the patient support surface at a second pediatric patient-restraining height greater than the first adult patient-restraining height, and (iii) a third out-of-the-way down position where the top of the at least one sideframe is generally disposed below the patient support surface. Sideframe locking mechanisms are provided for selectively locking the at least one sideframe in the first adult patient-restraining raised position and the second pediatric patient-restraining fully-raised position.

14 Claims, 13 Drawing Sheets

U.S. PATENT DOCUMENTS

| | | | | | |
|---|---|---|---|---|---|
| 3,063,066 | A | | 11/1962 | Peck et al. | 5/429 |
| 3,345,653 | A | | 10/1967 | Mixon | 5/97 |
| 3,351,961 | A | | 11/1967 | Daniels et al. | 5/430 |
| 3,419,922 | A | | 1/1969 | Malherbe | 5/430 |
| 3,641,598 | A | | 2/1972 | Feldstein | 5/100 |
| 3,683,430 | A | * | 8/1972 | Bradley | 5/279.1 |
| 3,763,507 | A | | 10/1973 | Propst | 5/100 |
| 3,774,247 | A | * | 11/1973 | Bradley | 5/53.2 |
| 3,780,387 | A | * | 12/1973 | Propst | 5/692 |
| 3,790,973 | A | * | 2/1974 | Bradley | 5/53.2 |
| 3,848,278 | A | * | 11/1974 | Propst | 5/603 |
| 3,896,514 | A | | 7/1975 | Feldstein | 5/100 |
| 3,921,233 | A | | 11/1975 | Mann | 5/97 |
| 3,930,273 | A | | 1/1976 | Stern | 5/430 |
| 4,215,446 | A | | 8/1980 | Mahoney | 5/425 |
| 4,226,452 | A | | 10/1980 | Hoffman et al. | 5/100 X |
| 4,439,880 | A | | 4/1984 | Koncelik et al. | 5/425 X |
| 4,530,528 | A | | 7/1985 | Shamie | 5/100 X |
| 4,628,552 | A | * | 12/1986 | Magistretti | 5/52 |
| 4,646,372 | A | * | 3/1987 | Hanson | 5/634 |
| 4,653,129 | A | | 3/1987 | Kuck et al. | 5/430 |
| 4,706,312 | A | | 11/1987 | Shamie | 5/100 X |
| 4,752,977 | A | | 6/1988 | Smith et al. | 5/93.1 |
| 4,754,507 | A | * | 7/1988 | Edge | 5/633 |
| 4,827,545 | A | | 5/1989 | Arp | 5/424 |
| 4,955,094 | A | * | 9/1990 | Mullaly | 5/633 |
| 4,958,392 | A | * | 9/1990 | Cannady | 5/507.1 |
| 5,036,556 | A | * | 8/1991 | Wieland | 5/53.1 |
| 5,044,025 | A | | 9/1991 | Hunsinger et al. | 5/424 |
| 5,068,935 | A | | 12/1991 | Hagopian | 5/425 X |
| 5,097,550 | A | | 3/1992 | Marra, Jr. | 5/424 |
| 5,146,632 | A | | 9/1992 | Li | 5/100 |
| 5,175,897 | A | | 1/1993 | Marra, Jr. | 5/425 |
| 5,191,663 | A | | 3/1993 | Holder et al. | 5/424 |
| 5,317,770 | A | | 6/1994 | Sakurai | 5/625 |
| 5,353,450 | A | * | 10/1994 | Katan | 5/53.2 |
| 5,511,257 | A | | 4/1996 | Hannes | 5/100 |
| 5,695,251 | A | * | 12/1997 | Scolari | 297/408 |
| 5,745,936 | A | | 5/1998 | Van McCutchen et al. | 5/425 X |
| 5,771,508 | A | * | 6/1998 | Messina | 5/53.2 |
| 5,802,634 | A | | 9/1998 | Onishi et al. | 5/93.2 |
| 5,806,111 | A | | 9/1998 | Heimbrock et al. | 5/86.1 |
| 5,878,452 | A | | 3/1999 | Brooke et al. | 5/428 |
| 5,898,964 | A | | 5/1999 | Stanley | 5/425 X |
| 6,185,767 | B1 | | 2/2001 | Brooke et al. | 5/425 X |
| 6,339,855 | B1 | * | 1/2002 | Socha et al. | 5/93.1 |
| 6,446,283 | B1 | | 9/2002 | Heimbrock et al. | 5/425 |
| 6,640,361 | B2 | * | 11/2003 | Heimbrock et al. | 5/430 |
| 6,684,420 | B2 | * | 2/2004 | Koenig et al. | 5/93.1 |
| 2003/0019035 | A1 | | 1/2003 | Heimbrock et al. | 5/428 |

* cited by examiner

FIG. 16
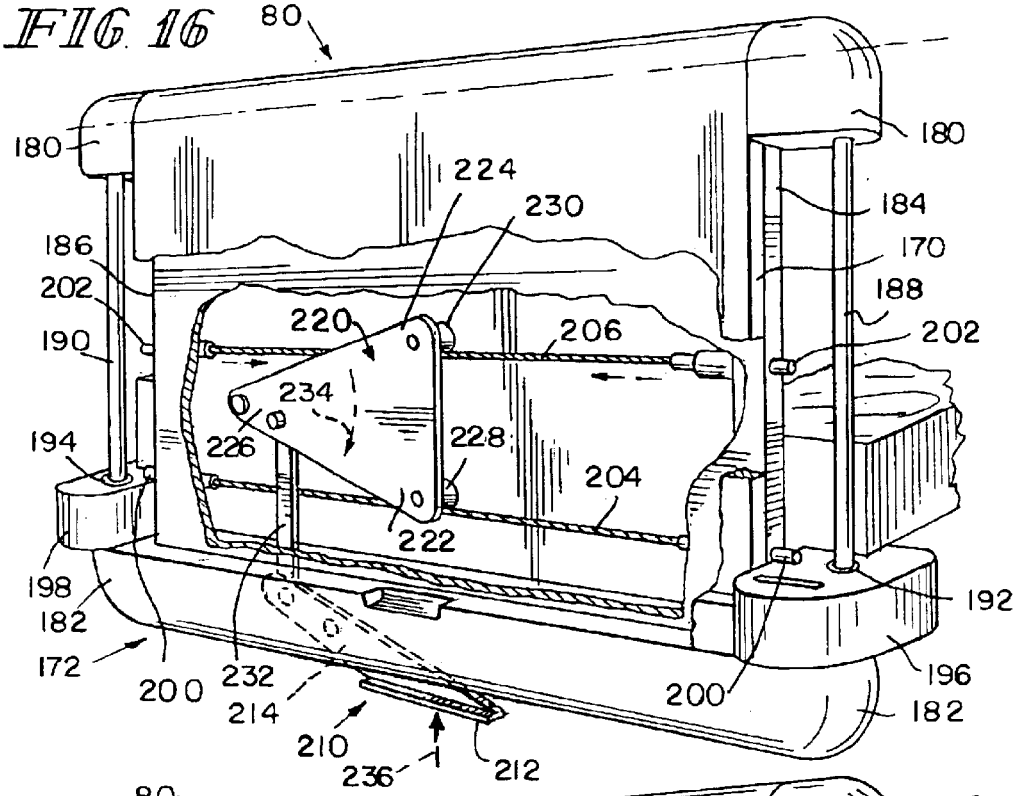
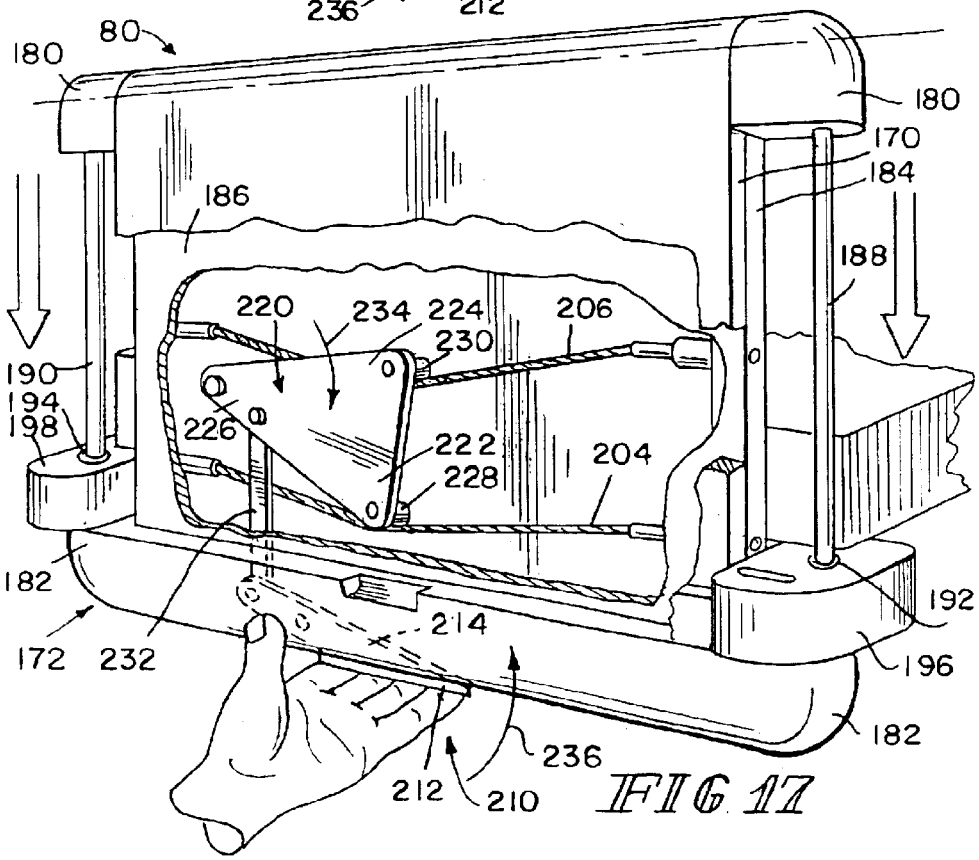
FIG. 17

CONVERTIBLE STRETCHER

CROSS-REFERENCE TO RELATED APPLICATIONS

This is a division of U.S. Ser. No. 10/201,144 filed Jul. 23, 2002, now U.S. Pat. No. 6,640,361 which is a division of U.S. Ser. No. 09/482,367, filed Jan. 13, 2000, now U.S. Pat. No. 6,446,283. U.S. Ser. No. 09/482,367 claims the benefit of the filing dates of U.S. Ser. No. 60/116,826 filed Jan. 22, 1999 and U.S. Ser. No. 60/132,930 filed May 6, 1999. All are assigned to the same assignee as this application.

BACKGROUND AND SUMMARY OF THE INVENTION

The present invention generally relates to a stretcher, and more particularly, relates to an adult stretcher that can be readily converted to a pediatric stretcher.

Most hospitals use two different types of stretchers—adult and pediatric. In adult hospitals, pediatric stretchers can often be seen sitting idly in the hallways when not in use, which is generally most of the time. The need for two different types of stretchers increases costs and wastes space. This is a luxury hospitals can ill-afford in today's competitive environment. Thus, there is a need for an adult stretcher that can be readily converted to a pediatric stretcher.

The present invention will be described primarily as a hospital stretcher, but it will be understood that the same may be used in conjunction with any other patient support apparatus, such as a hospital bed.

According to an embodiment of this invention, a patient support apparatus includes a patient support deck having an upwardly-facing patient support surface, and at least one sideframe adjacent to a first side of the patient support apparatus, and movable between (i) a first raised position where the top of the at least one sideframe is generally disposed above the patient support surface at a first adult patient-restraining height, (ii) a second fully-raised position where the top of the at least one sideframe is generally disposed above the patient support surface at a second pediatric patient-restraining height greater than the first adult patient-restraining height, and (iii) a third out-of-the-way down position where the top of the at least one sideframe is generally disposed below the patient support surface.

In this embodiment, the patient support apparatus includes a first sideframe locking mechanism for selectively locking the at least one sideframe in the first raised position, and a second sideframe locking mechanism for selectively locking the at least one sideframe in the second fully-raised position. In preferred embodiments, there are two sideframes, one on each side of the stretcher, and each sideframe includes its own locking mechanisms for locking the sideframes in their respective first and second raised positions.

In accordance with an embodiment of the present invention, each sideframe includes spaced-apart, generally horizontal top and bottom rails, and a plurality of relatively closely spaced, generally vertical telescopic posts, coupling the top and bottom rails. Illustratively, the spacing between the generally vertical telescopic posts is about two and three eighth inches (about 6 centimeters) to prevent a pediatric patient from falling off the stretcher. In this embodiment, each telescopic post illustratively includes an upright member secured to the top rail and configured for reception in an upright inner sleeve secured to the bottom rail. The upright member may include a roller coupled to its free end for slidable reception in the upright inner sleeve. Preferably, the sideframe components are all padded with an inner layer of spongy material and an outer soft layer of tough material to prevent tearing.

According to the present invention, one of the sideframe locking mechanism includes a lower bracket coupled to the bottom rail, an upper bracket coupled to the top rail, and a latching bar movably coupled to the upper bracket for movement between a first position in a retaining slot in the lower bracket to lock the top rail to the bottom rail and a second position out of the retaining slot to release the top rail. In preferred embodiments, a safety release paddle is movably coupled to the upper bracket for movement between a first position blocking the latching bar from moving out of the retaining slot, and a second position freeing the latching bar to move out of the retaining slot.

The patient support apparatus may include a headboard, a footboard, or both. The headboard and footboard preferably have first, second and third positions, which correspond with the first, second and third positions of the sideframes.

In one embodiment, first and second generally vertically-extending rods are coupled to the headboard adjacent to first and second sides thereof. The first and second generally vertically-extending rods are slidably received in first and second rod-receiving openings disposed in first and second corners of the intermediate frame adjacent to the first end thereof to movably support the headboard relative to the intermediate frame. Illustratively, the headboard has top and bottom outwardly-extending portions adjacent to the first and second sides thereof. The first and second generally vertically-extending rods are coupled to the outwardly-extending portions of the headboard adjacent to the first and second sides thereof respectively. In this embodiment, the undersides of the top outwardly-extending portions of the headboard engage the topsides of the first and second corners of the intermediate frame adjacent to the first end thereof to support the headboard in the third out-of-the-way down position.

According to another embodiment, the headboard locking mechanism includes first and second pairs of oppositely-disposed, spring-loaded retaining pins coupled to the headboard adjacent the first and second sides thereof. The first pair of spring-loaded retaining pins are configured to engage the first and second corners of the intermediate frame adjacent the first end thereof to support the headboard in the first raised position. The second pair of spring-loaded retaining pins are configured to engage the first and second corners of the intermediate frame adjacent the first end thereof to support the headboard in the second intermediate position. Illustratively, the headboard locking mechanism further comprises a headboard release handle movably coupled to the headboard, and first and second cables coupling the headboard release handle to the first and second pairs of spring-loaded retaining pins. The first and second pairs of spring-loaded retaining pins are retracted to release the headboard in response to the movement of the headboard release handle.

In still another embodiment, the headboard includes an extension panel movably coupled to the headboard for movement between a first out-of-the-way down position and a second generally vertically extended position. The extension panel is dimensioned such that the top of the extension panel is generally disposed above the patient support surface at the second pediatric patient-restraining height when the extension panel is disposed in the second generally vertically extended position while the headboard is disposed in the second intermediate position. A locking mechanism is provided to lock the extension panel in its first and second positions. The extension panel may also be movable to and lockable in a third generally horizontal shelf position.

In an alternate embodiment, the hospital stretcher includes at least one collapsible sideframe movably coupled to the intermediate frame adjacent to a first side thereof. The at least one collapsible sideframe includes a plurality of relatively closely-spaced upright assemblies having top and bottom-ends pivotally coupled to generally horizontal top and bottom rails. The upright assemblies each include an upright portion and an upright extension portion. The upright assemblies are staggered in two longitudinally-extending rows which are offset with respect to each other in a direction generally perpendicular to the longitudinal axis of the patient support deck so that the at least one sideframe can be raised and lowered without interference between adjoining upright assemblies. The pivotally-coupled upright assemblies are configured for movement between (i) a first raised position, where the top rail is generally disposed above the patient support surface at a first adult patient-restraining height, (ii) a second fully-raised position, where the top rail is generally disposed above the patient support surface at a second pediatric patient-restraining height greater than the first adult patient-restraining height, and (iii) a third out-of-the-way down position, where the top rail is generally disposed below the patient support surface. A sideframe locking mechanism selectively locks the at least one collapsible sideframe in the first raised position and the second fully-raised position.

In a further embodiment, a foot section of the patient support deck is pivotally coupled to the patient support deck about a transversely-extending pivot pin for movement between a first generally horizontal position and a second generally vertical position. A foot section locking mechanism selectively locks the foot section in the second generally vertical position to shorten the length of the patient support deck.

Additional features of the present invention will become apparent to those skilled in the art upon a consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 16 is a perspective view with a portion broken away of a headboard movably coupled to the intermediate frame adjacent a first end thereof for movement between (i) a first raised position, where the top of the headboard is generally disposed above the patient support surface at a first adult patient-restraining height, (ii) a second intermediate position, where the top of a flip-out extension panel pivotally coupled to the headboard is generally disposed above the patient support surface at a second pediatric patient-restraining height greater than the first adult patient-restraining height, and (iii) a third out-of-the-way down position where the top of the headboard is generally disposed below the patient support surface, and showing a first headboard locking mechanism including first and second pairs of spring-loaded retaining pins coupled to the headboard adjacent the first and second sides thereof, the interior ends of the first and second pairs of spring-loaded retaining pins being coupled to first and second tautly-held cables, the exterior ends of the first pair of spring-loaded retaining pins being configured to engage the first and second corners of the intermediate frame to hold the headboard in the first adult patient-restraining raised position, the exterior ends of the second pair of spring-loaded retaining pins being configured to engage the first and second corners of the intermediate frame to hold the headboard in the second intermediate position, FIG. 17 is a view of the headboard similar to FIG. 16, showing a headboard release handle 210 pivotally coupled to the headboard, a generally triangular plate member pivotally coupled to the headboard, first and second rollers rotatably coupled to the triangular plate member, a connecting link having ends pivotally coupled to the headboard release handle and the triangular plate member, activation of the headboard release handle causing the rollers to press downwardly on the first and second tautly-held cables to retract the spring-loaded retaining pins to release the headboard.

DETAILED DESCRIPTION OF THE DRAWINGS

Figure 1:
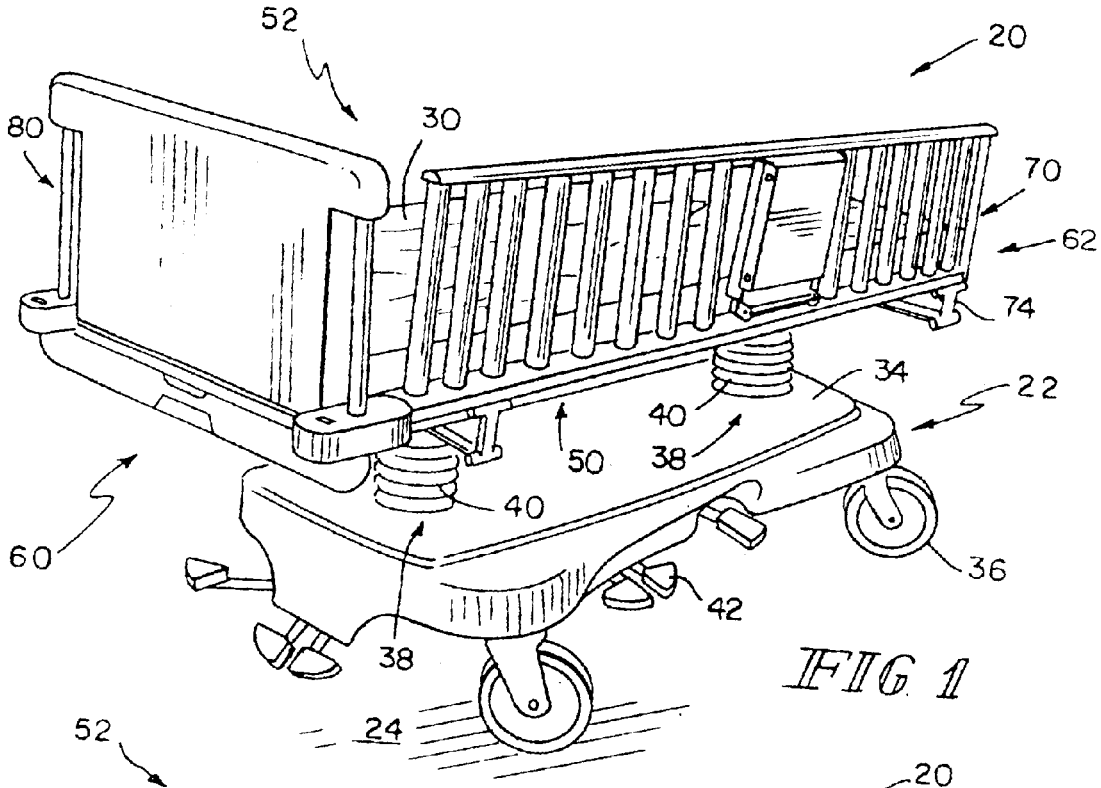
FIG. 1 is a perspective view showing a convertible hospital stretcher in accordance with the present invention, the hospital stretcher including a base, an intermediate frame supported on the base, an articulatable patient support deck having a patient support surface movably coupled to the intermediate frame, first and second sideframes movably coupled to the intermediate frame adjacent to first and second sides thereof, and first and second endframes movably coupled to the intermediate frame adjacent to first and second ends thereof, and further showing the first sideframe and the first endframe raised to a first raised position, where the tops of the first sideframe and the first endframe are generally disposed above the patient support surface at a first adult patient-restraining height.

As previously indicated, although the specification of this application discusses the present invention in terms of a hospital stretcher, the present invention has applicability to other patient support surfaces, such as a hospital bed.

As indicated above, this invention broadly comprises a patient support apparatus including a patient support deck having an upwardly-facing patient support surface, and at least one sideframe adjacent to a first side of the patient support apparatus, and movable between (i) a first raised position where the top of the at least one sideframe is generally disposed above the patient support surface at a first adult patient-restraining height, (ii) a second fully-raised position where the top of the at least one sideframe is generally disposed above the patient support surface at a second pediatric patient-restraining height greater than the first adult patient-restraining height, and (iii) a third out-of-the-way down position where the top of the at least one sideframe is generally disposed below the patient support surface.

Now referring to FIGS. 1–5, a hospital stretcher 20 includes a base frame 22 supported on a floor 24 by casters 36. An intermediate frame 26 is movably mounted to the base frame 22 between high and low positions. An articulating upper deck 28, including longitudinally spaced-apart head, seat, leg and foot sections (not shown), is coupled to the intermediate frame 26. Typically, the seat section is fixed to the intermediate frame 26, the head and leg sections are pivotally mounted to the seat section, and the foot section, in turn, is pivotally mounted to the leg section. A mattress 30 having an upwardly-facing patient support surface 32 is supported on the articulating upper deck 28.

The base frame 22 is covered by a protective shroud 34 to shield various mechanisms mounted to the base frame 22. The intermediate frame 26 is supported above the base frame 22 by a pair of longitudinally spaced-apart elevation mechanisms 38 well-known to those skilled in the art. The elevation mechanisms 38 are each covered by a protective boot 40. The stretcher 20 includes foot pedals 42 coupled to the elevation mechanisms 38. Foot pedals 42 can be depressed to raise, lower or tilt the intermediate frame 26 and the upper deck 28 coupled thereto.

The stretcher 20 includes a conventional brake and steer mechanism (not shown). The brake and steer mechanism includes a caster braking mechanism (not shown) which brakes the casters 36 to prevent them from rotating and swivelling when a brake-steer shaft is rotated to a braking position. The brake-steer mechanism further includes a steering mechanism (not shown) which selectively lowers a center wheel (not shown) into engagement with the floor 24. Additional details of the stretcher 20 can be found in U.S. Pat. No. 5,806,111, assigned to the same assignee as the present invention, which is herein incorporated by reference.

The stretcher 20 includes an elongated first side 50, an elongated second side 52, a longitudinal axis 58, a head end 60 and a foot end 62. As used in this description, the phrase "first side 50" will be used to denote the side of any referred-to object that is positioned to lie nearest the first side 50 of the stretcher 20 and the phrase "second side 52" will be used to denote the side of any referred-to object that is positioned to lie nearest the second side 52 of the stretcher 20. Likewise, the phrase "head end 60" will be, used to denote the end of any referred-to object that is positioned to lie nearest the head end 60 of the stretcher 20, and the phrase "foot end 62" will be used to denote the end of any referred-to object that is positioned to lie nearest the foot end 62 of the stretcher 20.

The intermediate frame 26 comprises longitudinally-extending tubes interconnecting two crosswise end plates 54, one at each end. The stretcher 20 includes first and second sideframes 70, 72 movably coupled to the intermediate frame 26 adjacent to the first and second sides 50, 52 thereof by means of conventional four bar linkage mechanisms 74, 76. According to the present invention, the sideframes 70, 72 are movable between (i) a first raised position shown in FIG. 1, where the tops of the sideframes 70, 72 are disposed above the patient support surface at a first adult patient-restraining height, (ii) a second fully-raised position shown in FIG. 2, where the tops of the sideframes 70, 72 are disposed above the patient support surface at a second pediatric patient-restraining height greater than the first adult patient-restraining height, and (iii) a third out-of-the-way down position shown in FIG. 3, where the tops of the sideframes 70, 72 are generally disposed below the patient support surface. Illustratively, the first adult patient-restraining height (dimension "a" in FIG. 7) is about eleven inches (about 28 centimeters), and wherein the second pediatric patient-restraining height (dimension "b" in FIG. 8) is about twenty inches (about 50 centimeters).

Figure 2:
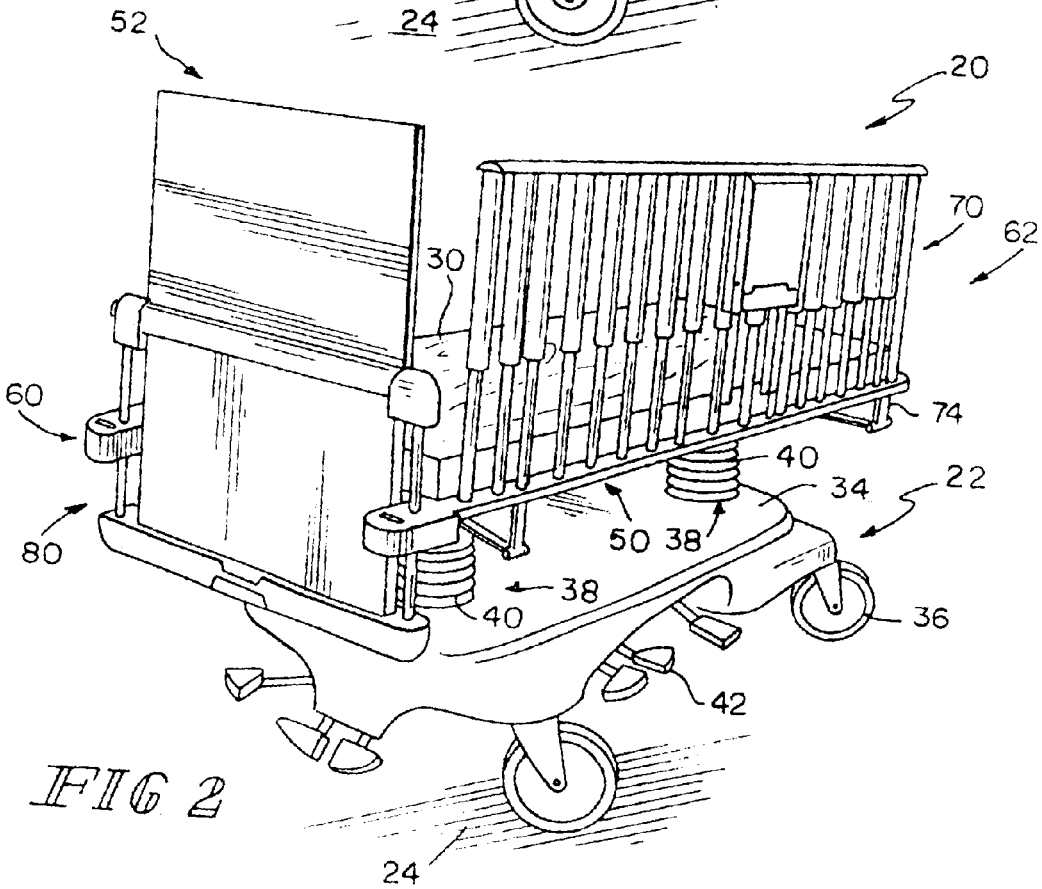
FIG. 2 is a view similar to FIG. 1, showing the first sideframe and the first endframe raised to a second fully-raised position, where the tops of the first sideframe and the first endframe are generally disposed above the patient support surface at a second pediatric patient-restraining height greater than the first adult patient-restraining height.
Figure 3:
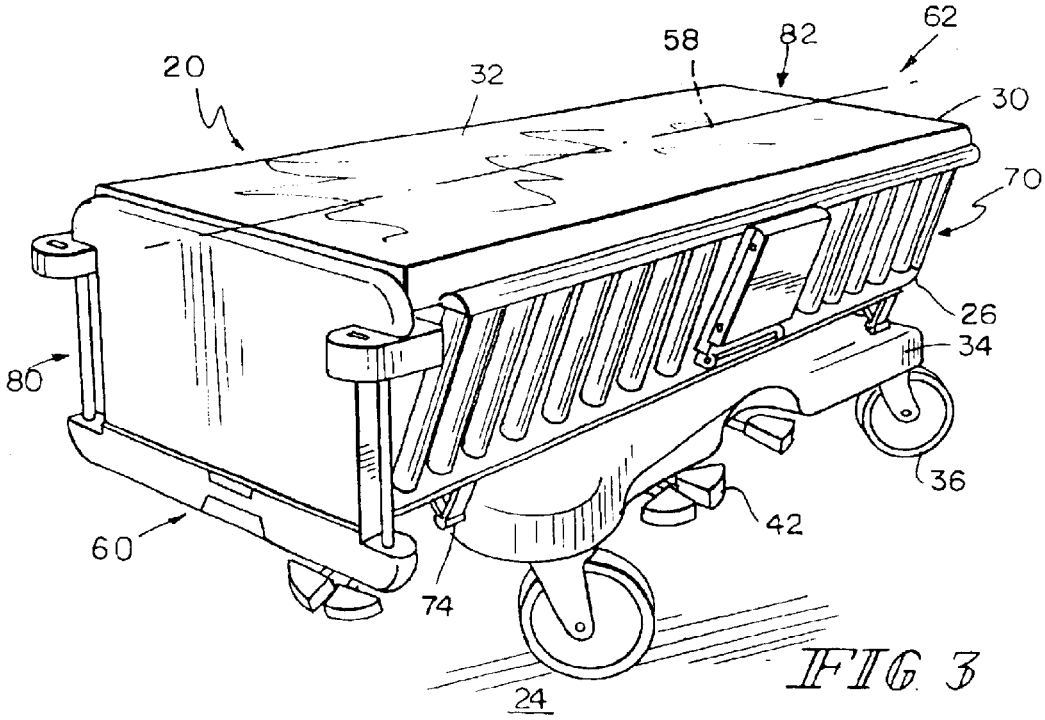
FIG. 3 is a view similar to FIGS. 1 and 2, showing both sideframes and both endframes lowered to a third out-of-the-way down position, where the tops of the sideframes and the endframes are generally disposed below the patient support surface to provide maximum patient access.

Additionally, the stretcher 20 of the present invention includes a headboard 80 and a footboard 82 (referred to collectively as "the endframes 80, 82") movably coupled to the intermediate frame 26 adjacent to the head and foot ends 60, 62 thereof for movement between (i) a first raised position shown in FIG. 1, where the tops of the endframes 80, 82 are generally disposed above the patient support surface at a first adult patient-restraining height, (ii) a second intermediate position shown in FIG. 2, where the tops of the respective flip-out extension panels 170 pivotally coupled to the endframes 80, 82 are generally disposed above the patient support surface at a second pediatric patient-restraining height greater than the first adult patient-restraining height, and (iii) a third out-of-the-way down position shown in FIG. 3, where the tops of the endframes 80, 82 are generally disposed below the patient support surface.

Figure 4:
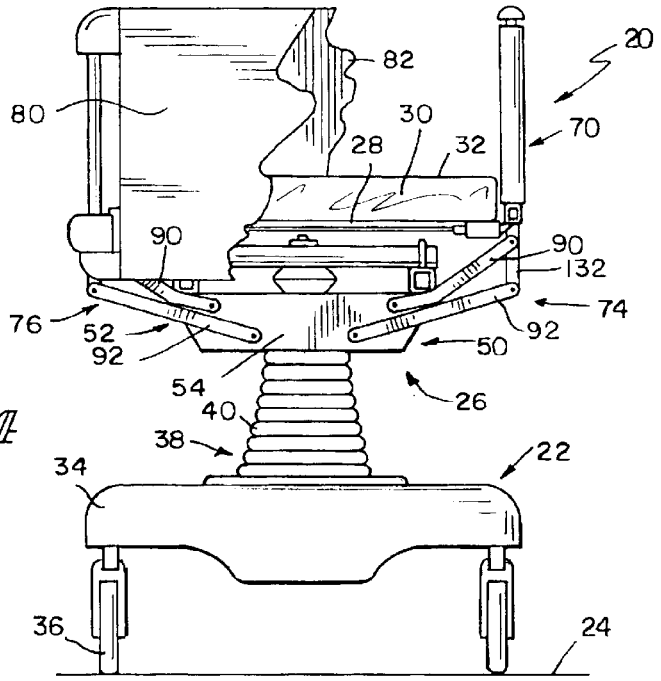
FIG. 4 is an end view showing the first and second sideframes and the first and second endframes raised to the first adult patient-restraining raised position.
Figure 5:
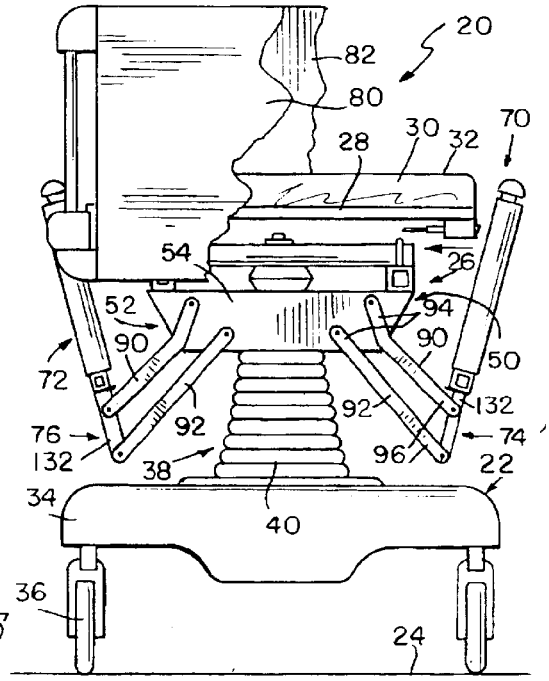
FIG. 5 is an end view similar to FIG. 4, showing the first and second sideframes lowered to the third maximum patient access, out-of-the-way down position, while showing the first and second endframes remaining in the first adult patient-restraining raised position.

As shown in FIGS. 4 and 5, each four bar linkage mechanism 74 and 76 includes two sets of first and second spaced-apart links 90, 92, each having inner and outer ends 94, 96. One set of the spaced-apart links 90, 92 is located adjacent to the head end 60 on the first side 50 of the intermediate frame 26. The other set of the spaced-apart links 90, 92 is located adjacent to the foot end 62 of the intermediate frame 26, also on the first side 50 thereof. The inner ends 94 of the links 90, 92 are pivotally coupled to the end plates 54. The outer ends 96 of the links 90, 92, on the other hand, are pivotally coupled to the sideframes 70, 72 as shown.

Figure 6:
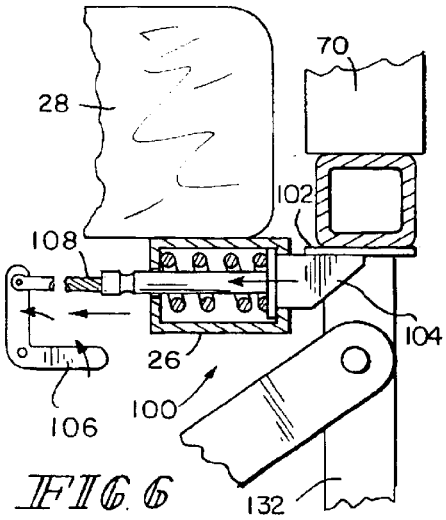
FIG. 6 is an end view showing a first sideframe locking mechanism for selectively locking the first sideframe in the first raised position, and further showing a strike plate attached to the first sideframe supported by a spring-loaded camming striker attached to the intermediate frame.

Referring to FIG. 6, a first sideframe locking mechanism 100 is coupled to the intermediate frame 26 on the first side 50 for selectively locking the first sideframe 70 in the first adult patient-restraining raised position. A similar sideframe locking mechanism 100 is coupled to the intermediate frame 26 on the second side 52 for selectively locking the second sideframe 72 in the first adult patient-restraining raised position. Since both sideframe locking mechanisms 100 are similar, only the first sideframe locking mechanism 100 on the first side 50 will be described herein.

The first sideframe locking mechanism 100 illustratively includes a strike plate 102 attached to the first sideframe 70, and a spring-loaded, retractable camming striker 104 attached to the intermediate frame 26. The strike plate 102 attached to the first sideframe 70 passes by the spring-loaded camming striker 104 attached to the intermediate frame 26 when the first sideframe 70 is raised to the first raised position to cause the spring-loaded camming striker 104 to momentarily retract away from the first sideframe 70 to allow the first sideframe 70 to be raised. The spring-loaded camming striker 104 then extends back toward the first sideframe 70 to lock the first sideframe 70 in the first raised position shown in FIG. 1.

The first sideframe locking mechanism 100 further includes a first sideframe release handle 106 movably coupled to the intermediate frame 26, and a cable 108 coupling the first sideframe release handle 106 to the spring-loaded camming striker 104. The camming striker 104 is retracted to release the first sideframe 70 in response to the movement of the first sideframe release handle 106. Although the first sideframe locking mechanism 100 described herein comprises a strike plate 102 and a spring-loaded camming striker 104, it is understood that any other suitable mechanism may be used instead.

Figure 7:
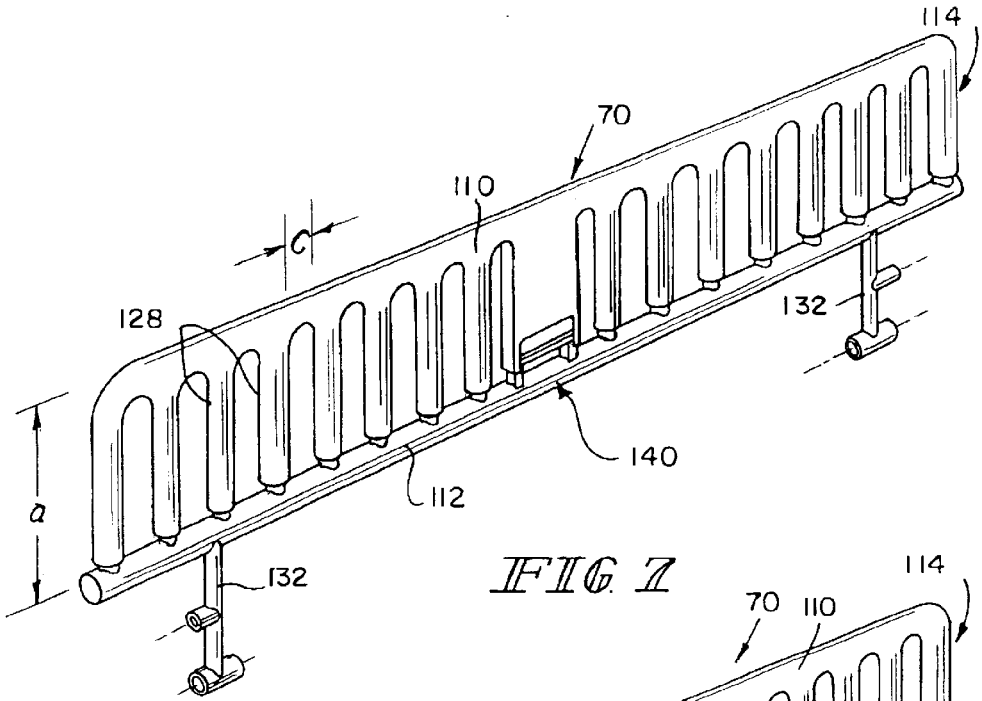
FIG. 7 is a perspective view showing the first sideframe in the first adult patient-restraining raised position.
Figure 8:
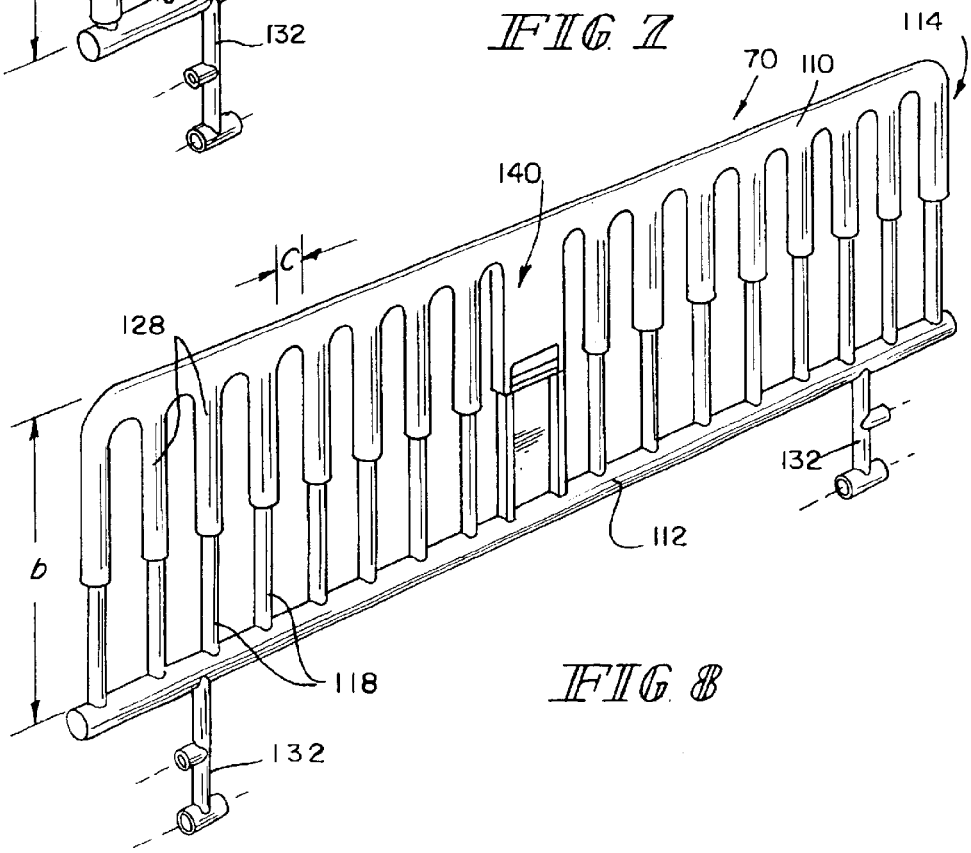
FIG. 8 is a perspective view showing the first sideframe in the second pediatric patient-restraining, fully-raised position.
Figure 9:
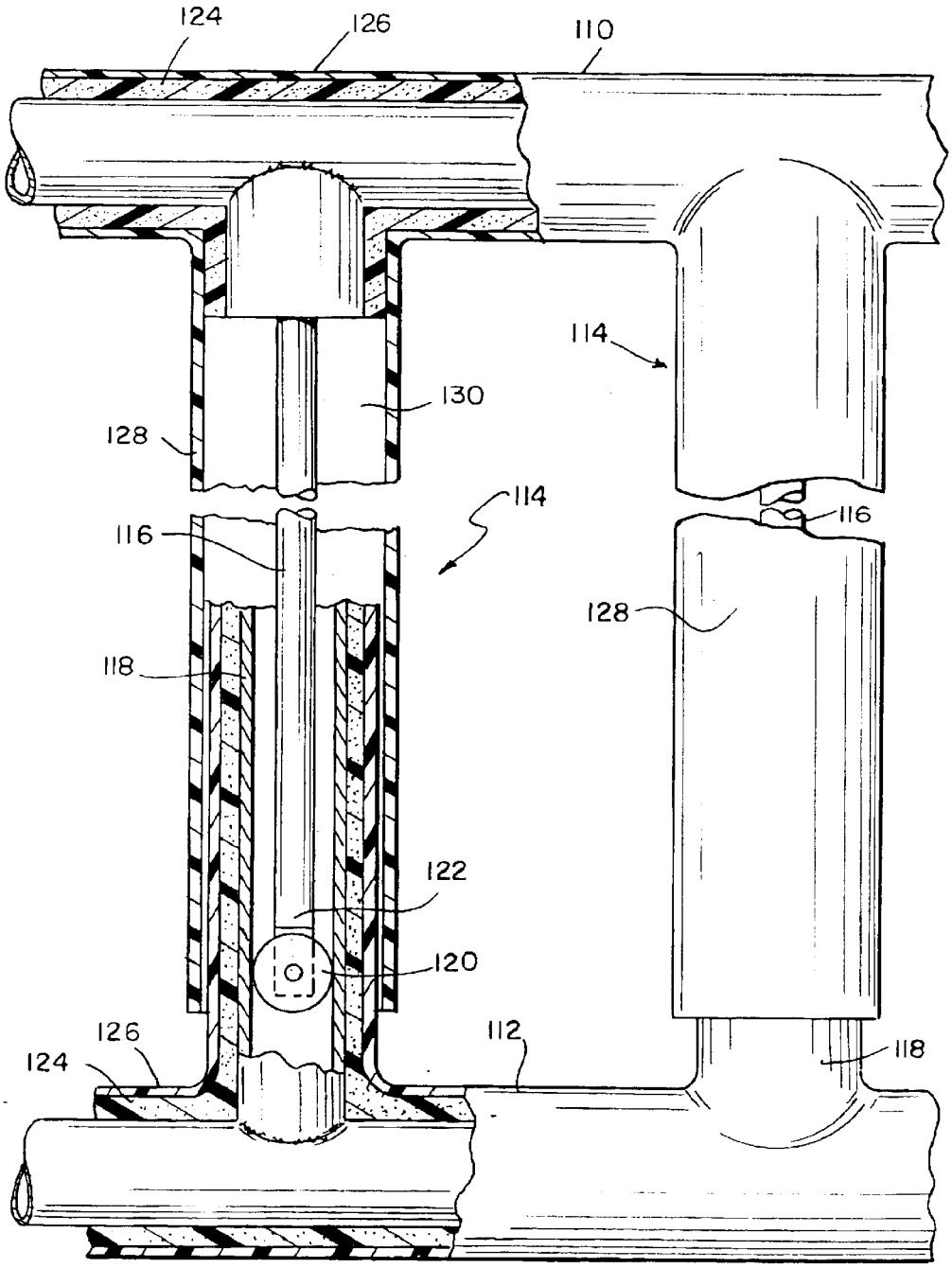
FIG. 9 is a partial cross-sectional view of the first sideframe showing spaced-apart, generally horizontal top and bottom rails and a plurality of relatively closely spaced, generally vertical telescopic posts coupling the top and bottom rails, each telescopic post including an upright rod secured to the top rail and configured for reception in an upright inner sleeve secured to the bottom rail, the upright rod including a roller coupled to its free end for slidable reception in the upright inner sleeve, and further showing a plurality of upright outer sleeves depending downwardly from the generally horizontal top rail around the upright rods to form annular spaces, the upright inner sleeves sliding over the upright rod/roller assemblies and upright outer sleeves sliding over the upright inner sleeves, the sideframe components being all preferably padded to protect the patients and the caregivers.
Figure 10:
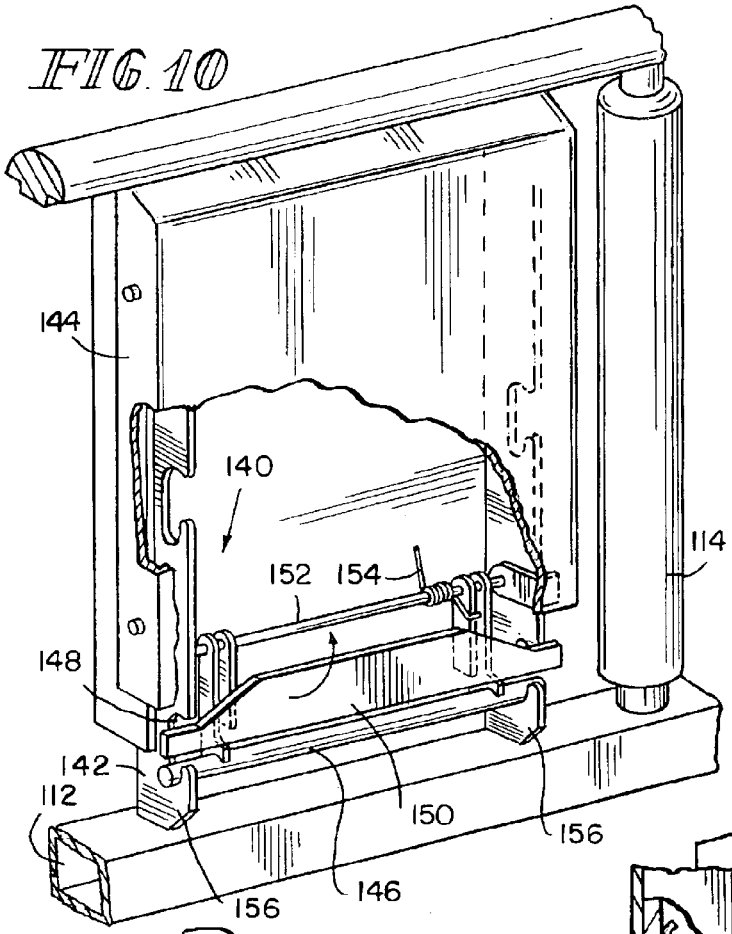
FIG. 10 is a perspective view with a portion broken away of the second sideframe locking mechanism showing a lower bracket secured to the bottom rail and an upper bracket secured to the top rail, and a latching bar pivotally coupled to the upper bracket about a generally horizontal longitudinal axis for movement between a first position located in an outwardly-opening retaining slot in the lower bracket to lock the top rail to the bottom rail, and a second position located outside the outwardly-opening retaining slot to release the top rail, and further showing a safety release paddle pivotally coupled to the upper bracket about the same generally horizontal longitudinal axis for movement between a first position blocking the latching bar from moving out of the outwardly-opening retaining slot and a second position freeing the latching bar to move out of the outwardly-opening retaining slot, and a spring urging the latching bar and the safety release paddle into the outwardly-opening retaining slot.
Figure 11:
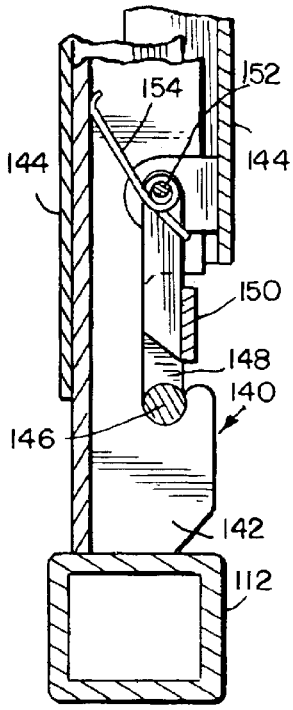
FIG. 11 is a cross-sectional end view of the second sideframe locking mechanism showing the safety release paddle blocking the latching bar from moving out of the outwardly-opening retaining slot.
Figure 12:
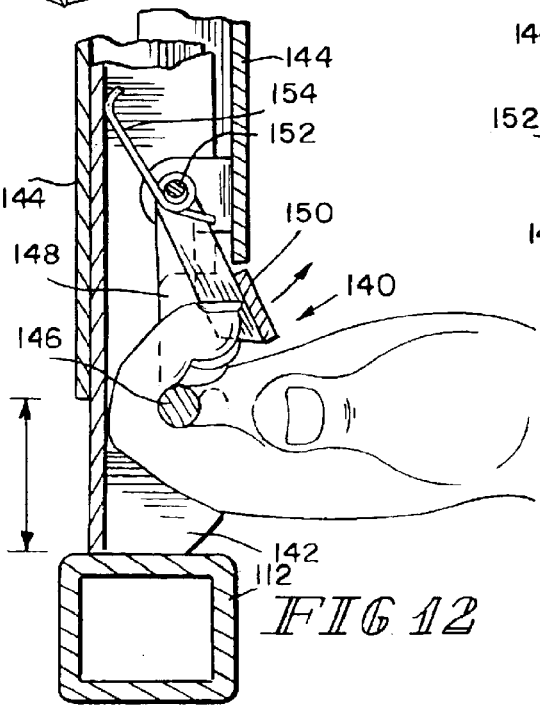
FIGS. 12–15 are all cross-sectional end views of the second sideframe locking mechanism similar to FIG. 11, showing the progressive stages involved in raising the first sideframe from the first adult patient-restraining raised position to the second pediatric patient-restraining, fully-raised position.
Figure 13:
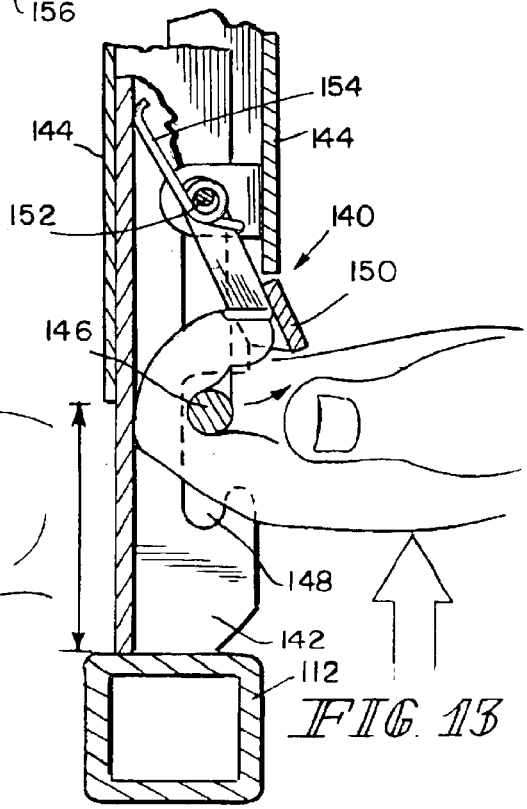
Figure 14:
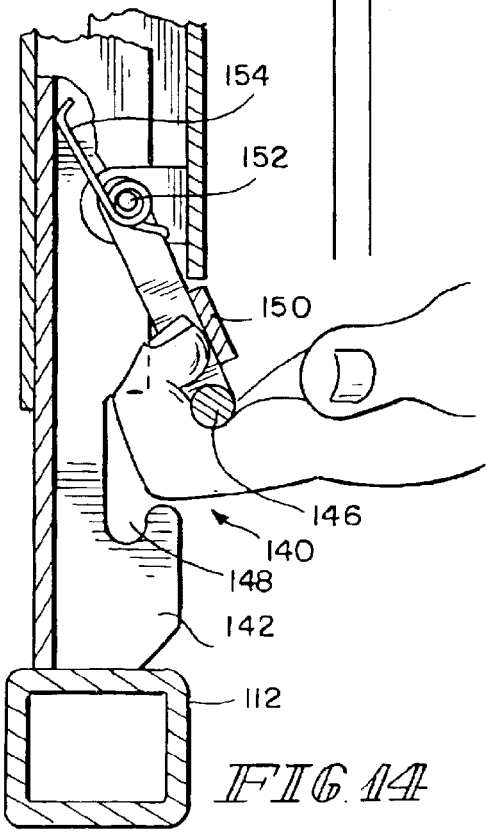
Figure 15:
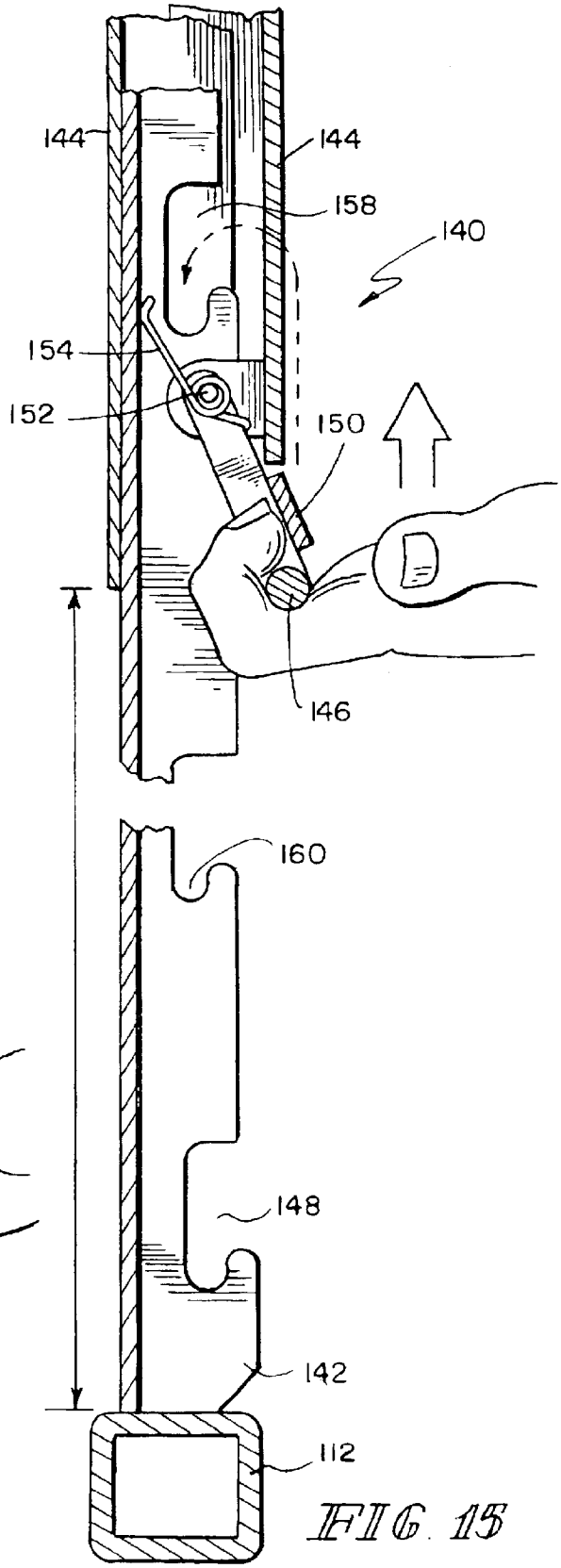

Since the construction of the sideframes 70, 72 is similar, only the sideframe 70 on the first side 50 will be described. As shown in FIGS. 7–9, the sideframe 70 includes spaced-apart, generally horizontal top and bottom rails 110 and 112, and a plurality of relatively closely spaced, generally vertical telescopic posts 114 coupling the top and bottom rails. Illustratively, the spacing between the generally vertical telescopic posts 114 (dimension "c" in FIGS. 7 and 8) is about two and three eighth inches (6 centimeters) to prevent a pediatric patient from falling off the stretcher 20. Each telescopic post 114 illustratively includes an upright member or rod 116 secured to the top rail 110 and configured for reception in an upright inner sleeve 118 secured to the bottom rail 112. The upright rod 116 may include a roller 120 coupled to its free end 122 for slidable reception in the upright inner sleeve 118. The use of an upright rod/roller arrangement permits the use of a smaller diameter upright rod 116, and also reduces the likelihood of an upright rod 116 getting jammed in an upright inner sleeve 118. It is understood that the sideframe components may be made from any suitable lightweight, high strength and rigid materials by using conventional manufacturing or forming techniques.

As shown in FIG. 9, the sideframe 70 is suitably padded to protect patients and caregivers. The padding is soft but has a tough outer surface or sheath to prevent tearing. The upright inner sleeves 118 and the bottom rail 112 are padded with a spongy coating 124, and then overcoated with a tough outer layer 126 (such as vinyl) by a dip-coating or over-molding process. The top rail 110 is also coated with a spongy material 124, and then coated with a tough outer layer 126 with upright mandrels (not shown) in place. After coating, the mandrels are removed to form upright outer sleeves 128 depending downwardly from the top rail 110. The upright rods 116 are then screwed into the top rail 110 inside the downwardly-depending upright outer sleeves 128 to form annular spaces 130 therebetween. When assembled, the upright inner sleeves 118 secured to the bottom rail 112 slide over the upright rod/roller assemblies attached to the top rail 110. Simultaneously, the downwardly-depending upright outer sleeves 128 slide over the upright inner sleeves 118 secured to the bottom rail 112. The bottom rail 112 includes two downwardly-depending connecting rods 132 for connecting the side frame 70 to the four bar linkage mechanism 74 as shown in FIGS. 4 and 5.

Referring to FIGS. 10–15, a second sideframe locking mechanism 140 is coupled to the sideframe 70 on the first side 50 to selectively lock the sideframe 70 in the first adult patient-restraining raised position shown in FIG. 1, and also in the second pediatric patient-restraining fully-raised position shown in FIG. 2. A similar sideframe locking mechanism 140 is coupled to the sideframe 72 on the second side 52. Since the two mechanisms 140 are similar, only the locking mechanism 140 on the first side 50 will be described.

The locking mechanism 140 on the first side 50 includes a lower bracket 142 coupled to the bottom rail 112, an upper bracket 144 coupled to the top rail 110, and a latching bar 146 movably coupled to the upper bracket 144 for movement between (i) a first position (shown in FIG. 11) where the opposite ends of the latching bar 146 are located in a first pair of outwardly-opening, oppositely-disposed retaining slots 148 in the lower bracket 142 to lock the sideframe 70 in the first adult patient-restraining raised position shown in FIG. 1, and (ii) a second position (shown in FIGS. 14 and 15) out of the retaining slots 148 to release the top rail 110.

A safety release paddle 150 is movably coupled to the upper bracket 144 for movement between (i) a first position (shown in FIG. 11) blocking the latching bar 146 from moving out of the retaining slots 148, and (ii) a second position (shown in FIGS. 12–15) freeing the latching bar 146 to move out of the retaining slots 148. The safety release paddle 150 prevents the latching bar 146 from accidentally moving out of the retaining slots 148. The safety release paddle 150 must be first moved out of the retaining slots 148 before the latching bar 146 can move out of the retaining slots 148. Only after both motions have been sequentially completed, can the sideframe 70 be raised or lowered.

Illustratively, both the latching bar 146 and the safety release paddle 150 are pivotally coupled to the upper bracket 144 about a generally horizontal, longitudinally-extending shaft 152 for movement between their respective first and second positions. A spring 154 urges the latching bar 146 and the safety release paddle 150 to remain in the retaining slots 148.

The lower bracket 142, in turn, comprises first and second longitudinally spaced-apart, generally vertical upright members 156 coupled to the bottom rail 112, and forming the retaining slots 148. As mentioned above, the opposite ends of the latching bar 146 and the safety release paddle 150 are both disposed in the retaining slots 148 when the sideframe 70 is in the first adult patient-restraining raised position shown in FIGS. 1 and 4. The upright members 156 include a second pair of outwardly-opening, oppositely-disposed retaining slots 158, which are vertically spaced apart from the first pair of retaining slots 148. The opposite ends of the latching bar 146 and the safety release paddle 150 are disposed in the second pair of retaining slots 158 when the sideframe 70 is in the second pediatric patient-restraining fully-raised position shown in FIG. 2. The upright members 156 may include a third pair of outwardly-opening, oppositely-disposed retaining slots 160 intermediate of the first and second pairs of retaining slots 148, 158 to additionally support the sideframe 70 in an intermediate position. A suitable damping member, such as a gas spring, may be connected between the intermediate frame 26 and each of the sideframes 70, 72 to provide a smooth lifting and lowering movement of the sideframes 70, 72.

Figure 18A:
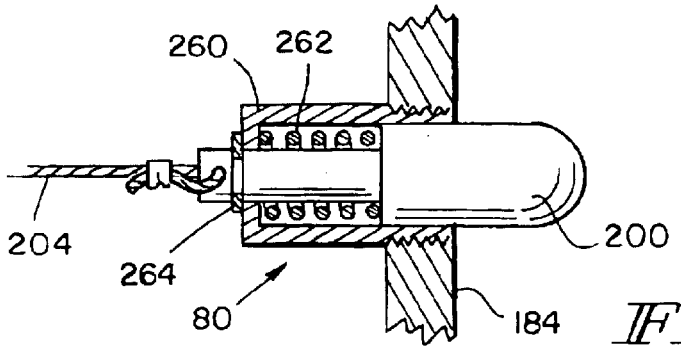
FIG. 18*a* is a sectional view showing a retaining pin slidably mounted inside a sleeve screwed to a side of the headboard, a spring biasing the retaining pin outwardly, a retaining washer secured to the interior end of the retaining pin to hold it in place, and a cable coupled to the interior end of the retaining pin.
Figure 18:
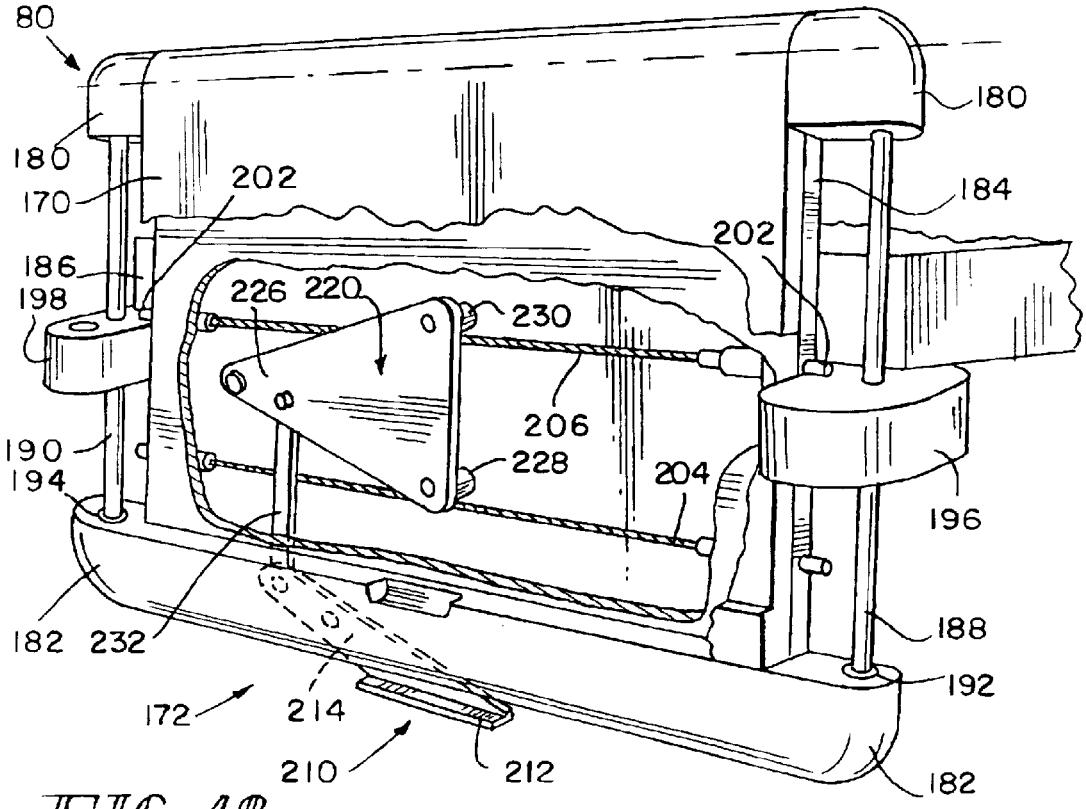
FIG. 18 is a view of the headboard similar to FIGS. 16 and 17, showing the exterior ends of the second pair of spring-loaded retaining pins engaging the first and second corners of the intermediate frame to support the headboard in the second intermediate position between the first raised position and the third out-of-the-way down position.
Figure 19:
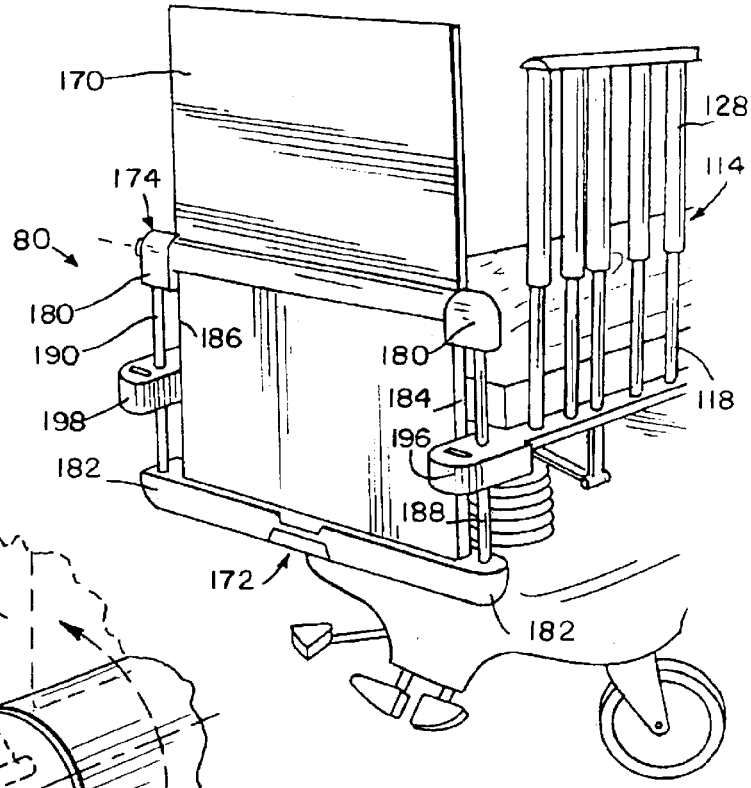
FIG. 19 is a perspective view of the headboard showing the flip-out extension panel in a generally vertically extended position where the top of the flip-out extension panel is disposed above the patient support surface at the second pediatric patient-restraining height.

Referring to FIGS. 16–19, a headboard 80 is movably coupled to the intermediate frame 26 adjacent to the head end 60 for movement between (i) a first raised position shown in FIGS. 16 and 17, where the top of the headboard 80 is disposed above the patient support surface at the first adult patient-restraining height, (ii) a second intermediate position shown in FIGS. 18 and 19, where the top of a flip-out extension panel 170 pivotally coupled to the headboard 80 is disposed above the patient support surface at a second pediatric patient-restraining height greater than the first adult patient-restraining height as shown in FIG. 19, and (iii) a third out-of-the-way down position shown in FIG. 3, where the top of the headboard 80 is generally disposed below the patient support surface.

Figure 20:
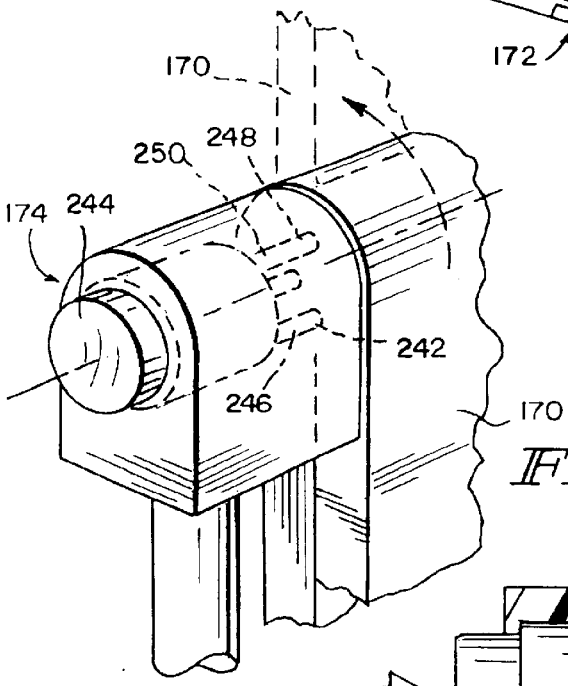
FIG. 20 is a perspective view of a second headboard locking mechanism for selectively locking the flip-out extension panel in a first out-of-the-way down position and the second generally vertically extended position.
Figure 21:
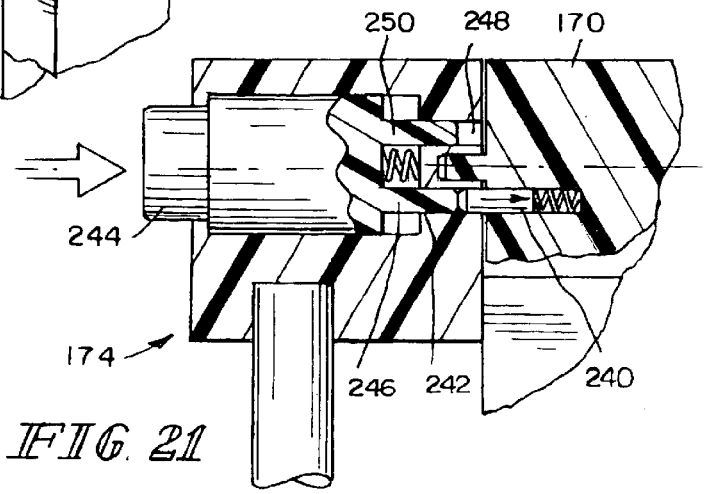
FIG. 21 is a cross-sectional view of the second headboard locking mechanism showing a spring-loaded locking pin coupled to the flip-out extension panel which is configured to enter a first pin-receiving receptacle in the headboard when the flip-out extension panel is in the first out-of-the-way down position to lock the flip-out extension panel in the first out-of-the-way down position, the second headboard locking mechanism including a spring-loaded button movably coupled to the headboard, the spring-loaded button having a first finger which is configured to extend into the first pin-receiving receptacle in the headboard to push the spring-loaded locking pin out of the first pin-receiving receptacle when the flip-out extension panel is in the first out-of-the-way down position to free the flip-out extension panel, the spring-loaded locking pin being configured to enter a second pin-receiving receptacle in the headboard when the flip-out extension panel is in the second generally upright position to lock the flip-out extension panel in the second generally upright position, the spring-loaded button including a second finger which is configured to extend into the second pin-receiving receptacle in the headboard to push the spring-loaded locking pin out of the second pin-receiving receptacle when the flip-out extension panel is in the second generally upright position to free the flip-out extension panel.

A first headboard locking mechanism 172, shown in FIGS. 16–18, is provided adjacent to the head end 60 of the intermediate frame 26 to selectively lock the headboard 80 in the first adult patient-restraining raised position shown in FIG. 16, and also in the second intermediate position shown in FIGS. 18 and 19. A second headboard locking mechanism 174, shown in FIGS. 19–21, is coupled to the headboard 80 for selectively locking the flip-out extension panel 170 in a generally upright position shown in FIG. 19, where the top of the flipout extension panel 170 is disposed above the patient support surface at the second pediatric patient-restraining height.

A footboard 82 is movably coupled to the intermediate frame 26 adjacent to the foot end 62 for movement between (i) a first raised position where the top of the footboard is disposed above the patient support surface at a first adult patient-restraining height, (ii) a second intermediate position where the top of a flip-out extension panel pivotally coupled to the footboard is disposed above the patient support surface at a second pediatric patient-restraining height greater than the first adult patient-restraining height, and (iii) a third out-of-the-way down position where the top of the footboard is generally disposed below the patient support surface. A first footboard locking mechanism 172 is provided adjacent to the foot end 62 of the intermediate frame 26 to selectively lock the footboard 82 in the first adult patient-restraining raised position, and also in the second intermediate position. A second footboard locking mechanism 174 is coupled to the footboard 82 for selectively locking the flip-out extension panel in a second generally upright position.

Since the construction of the headboard 80 and the footboard 82 is similar in this particular embodiment, only the headboard 80, and the associated locking mechanisms 172, 174, will be described herein. Illustratively, the headboard 80 has top and bottom outwardly-extending portions 180, 182 adjacent to first and second sides 184, 186 thereof. First and second generally vertically-extending rods 188, 190 are coupled to the top and bottom outwardly-extending portions 180, 182 of the headboard 80 adjacent to the first and second sides 184, 186 respectively. The first and second generally vertically-extending rods 188, 190 are slidably received in first and second rod-receiving openings 192, 194 disposed in first and second corners 196, 198 of the intermediate frame 26 adjacent to the head end 60 to movably support the headboard 80 relative to the intermediate frame 26. The undersides of the top outwardly-extending portions 180 of the headboard 80 engage the topsides of the first and second corners 196 and 198 of the intermediate frame 26 adjacent to the head end 60 to support the headboard 80 in the third out-of-the-way down position as shown in FIG. 3.

The first headboard locking mechanism 172 includes first and second pairs of oppositely-disposed, spring-loaded retaining pins 200, 202 coupled to the headboard 80 adjacent to the first and second sides 184, 186 thereof. FIG. 18*a* illustrates the details of attaching a spring-loaded retaining pin 200 to the headboard 80. As shown therein, a retaining pin 200 is slidably mounted inside a sleeve 260 which is screwed to a side of the headboard 80. A spring 262 biases the retaining pin 200 outwardly. A retaining washer 264 is secured to the interior end of the retaining pin 200 to hold it in place. The interior ends of the first and second pairs of oppositely-disposed, spring-loaded retaining pins 200, 202 are coupled to first and second tautly-held cables 204, 206 respectively, as shown. Bullet shaped exterior ends of the first pair of spring-loaded retaining pins 200 are configured to engage the first and second corners 196, 198 of the intermediate frame 26 adjacent to the head end 60 thereof to hold the headboard 80 in the first adult patient-restraining raised position as shown in FIG. 16. Likewise, the exterior ends of the second pair of spring-loaded retaining pins 202 are configured to engage the first and second corners 196, 198 of the intermediate frame 26 adjacent to the head end 60 to hold the headboard 80 in the second intermediate position shown in FIG. 18.

A headboard release handle 210 includes a first end 212 forming a handle and a middle portion 214 pivotally coupled to the headboard 80. A generally triangular plate member 220 includes first and second ends 222, 224 rotatably supporting two rollers 228, 230 which rest against the first and second tautly-held cables 206, 208 respectively. A third end 226 of the generally triangular plate member 220 is pivotally coupled to the headboard 80. A connecting link 232 has its ends pivotally coupled to the headboard release handle 210 and the triangular plate member 220, as shown. The triangular plate member 220 is rotated clockwise in the direction of arrow 234 when the handle portion 212 of the headboard release handle 210 is lifted in the direction of arrow 236 as shown in FIG. 17. The clockwise rotation of the triangular plate member 220, in turn, causes the rollers 228, 230 to press downwardly on the first and second tautly-held cables 204, 206 to, in turn, retract the spring-loaded retaining pins 200, 202 to release the headboard 80.

As mentioned above, the flip-out extension panel 170 is pivotally coupled to the headboard 80 for movement between a first out-of-the-way down position shown in FIGS. 16–18, and the second generally upright position-shown in FIG. 19. The flip-out extension panel 170 is dimensioned such that the top of the flip-out extension panel 170 is disposed above the patient support surface at the second pediatric patient-restraining height when the flip-out extension panel 170 is disposed in the second generally upright position while the headboard 80 is disposed in the second intermediate position as shown in FIG. 19. Although the flip-out extension panel 170 is pivotally mounted to the headboard 80, it is understood that it may very well comprise a pull-out extension panel 368 that is slidably,received in a compartment provided in a headboard 360 in the manner shown in FIGS. 22–24.

As shown in FIGS. 20 and 21, the second headboard locking mechanism 174 includes a spring-loaded locking pin 240 coupled to the flip-out extension panel 170, and configured to enter a first pin-receiving receptacle 242 in the headboard 80 when the flip-out extension panel 170 is in the first out-of-the-way down position (shown in FIGS. 16–18) to lock the flip-out extension panel 170 in the first out-of-the-way down position. A spring-loaded button 244 is movably coupled to the headboard 80. The spring-loaded button 244 includes a first finger 246 which is configured to extend into the first pin-receiving receptacle 242 in the headboard 80 to push the spring-loaded locking pin 240 out of the first pin-receiving receptacle 242 when the flip-out extension panel 170 is in the first out-of-the-way down position to free the flip-out extension panel 170 for rotation.

The spring-loaded locking pin 240 is configured to enter a second pin-receiving receptacle 248 in the headboard 80 when the flip-out extension panel 170 is in the second generally upright position (shown in FIG. 19) to lock the flip-out extension panel in the second generally upright position. The spring-loaded button 244 includes a second finger 250 which is configured to extend into the second pin-receiving receptacle 248 in the headboard 80 to push the spring-loaded locking pin 240 out of the second pin-receiving receptacle 248 when the flip-out extension panel 170 is in the second generally upright position (shown in FIG. 19) to free the flip-out extension panel 170 for rotation.

In a further embodiment, the spring-loaded locking pin 240 is configured to enter a third pin-receiving receptacle (not shown) in the headboard 80 when the flip-out extension panel is in a third generally horizontal shelf position extending over the patient support surface 32 to lock the headboard in the third generally horizontal shelf position. The spring-loaded button 244 includes a third finger which is configured to extend into the third pin-receiving receptacle in the headboard 80 to push the spring-loaded locking pin 240 out of the third pin-receiving receptacle when the flip-out extension panel 170 is in the third generally horizontal shelf position to free the flip-out extension panel 170 for rotation.

Figure 28:
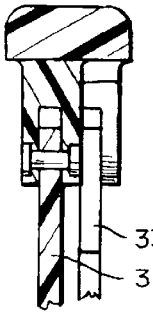
FIG. 28 is a cross-sectional view of the sideframe showing offset upright and upright extension portions.

An alternate embodiment of the present invention will be described with reference to FIGS. 22–28. As shown therein, the stretcher includes first and second collapsible sideframes 300, 302 movably coupled to an intermediate frame 304 adjacent to first and second sides 306, 308 thereof, a longitudinal axis 338, an upper deck 340 movably mounted to the intermediate deck 304, and a mattress 342 having a patient support surface 344. Since the construction of the two collapsible sideframes 300 and 302 is similar, only the sideframe 300 on the first side 306 will be described herein. The sideframe 300 includes a plurality of relatively closely-spaced upright assemblies 320 having top and bottom ends 322, 324. The top and bottom ends 322, 324 of the upright assemblies 320 are pivotally coupled to generally horizontal top and bottom rails 326, 328. The upright assemblies 320 each include an upright portion 330 and upright extension portion 332. The upright assemblies 320 are arranged in two longitudinally-extending rows 334, 336, which are offset with respect to each other in a direction generally perpendicular to the longitudinal axis 338 as shown in FIG. 28. The offset arrangement of the upright assemblies 320 permits the collapsible sideframes 300 and 302 to be raised and lowered without interference between adjoining upright assemblies 320. Illustratively, the odd numbered upright assemblies (1st, 3rd, 5th, etc.) are arranged in one row, and the even numbered upright assemblies (2nd, 4th, 6th, etc.) are arranged in another row. The collapsible sideframes 300, 302 are movable between (i) a first raised position shown in FIG. 22, where the top rails 326 are generally disposed above a patient support surface 344 at a first adult patient-restraining height, (ii) a second filly-raised position shown in FIG. 23, where the top rails 326 are generally disposed above the patient support surface 344 at a second pediatric patient-restraining height greater than the first adult patient-restraining height, and (iii) a third out-of-the-way down position shown in FIG. 24, where the top rails 326 are generally disposed below the patient support surface 344.

Figure 22:
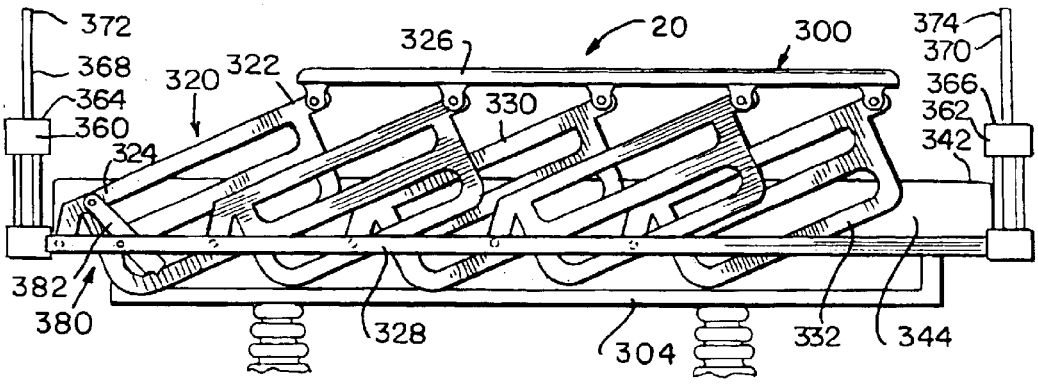
FIG. 22 is an alternate embodiment of a hospital stretcher in accordance with the present invention showing first and second collapsible sideframes movably coupled to the intermediate frame adjacent to first and second sides thereof, each collapsible sideframe including a plurality of relatively closely-spaced upright assemblies having top and bottom ends pivotally coupled to generally horizontal top and bottom rails, the upright assemblies each comprising an upright portion and an upright extension portion, the upright assemblies being staggered in two longitudinally-extending rows which are offset with respect to each other in a direction generally perpendicular to the longitudinal axis of the patient support deck to permit the collapsible sideframes to be raised and lowered without interference between adjoining upright assemblies, the upright assemblies being shown raised to a first raised position, where the top rails are generally disposed above the patient support surface at a first adult patient-restraining height.
Figure 23:
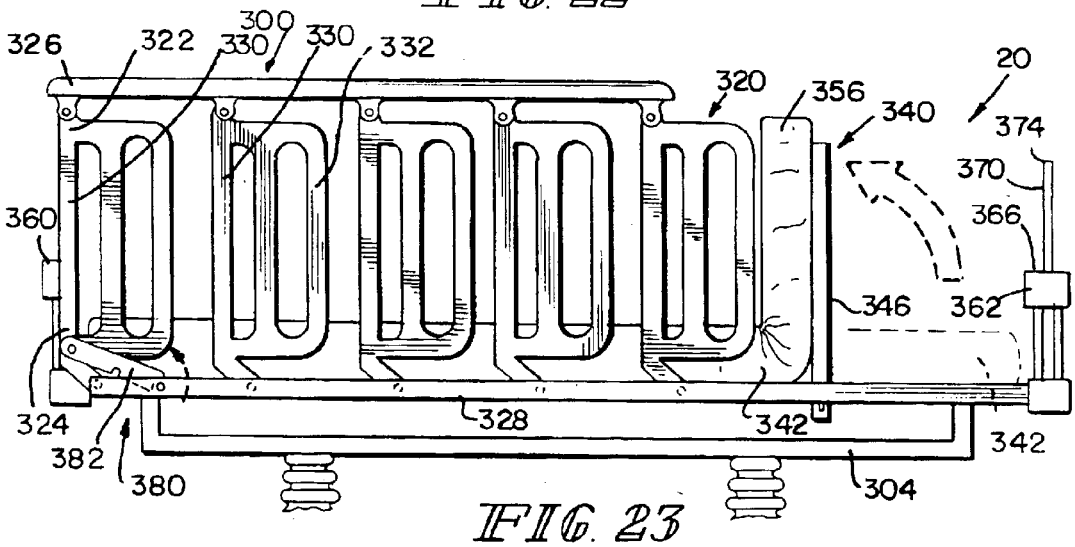
FIG. 23 is a view similar to FIG. 22, showing the upright assemblies raised to a second fully-raised position, where the top rails are generally disposed above the patient support surface at a second pediatric patient-restraining height greater than the first adult patient-restraining height, a foot section of the patient support deck and an associated portion of the mattress being shown pivoted up to a generally vertical upright position to reduce the length dimension of the patient support deck to a length more appropriate for pediatric patients.
Figure 24:
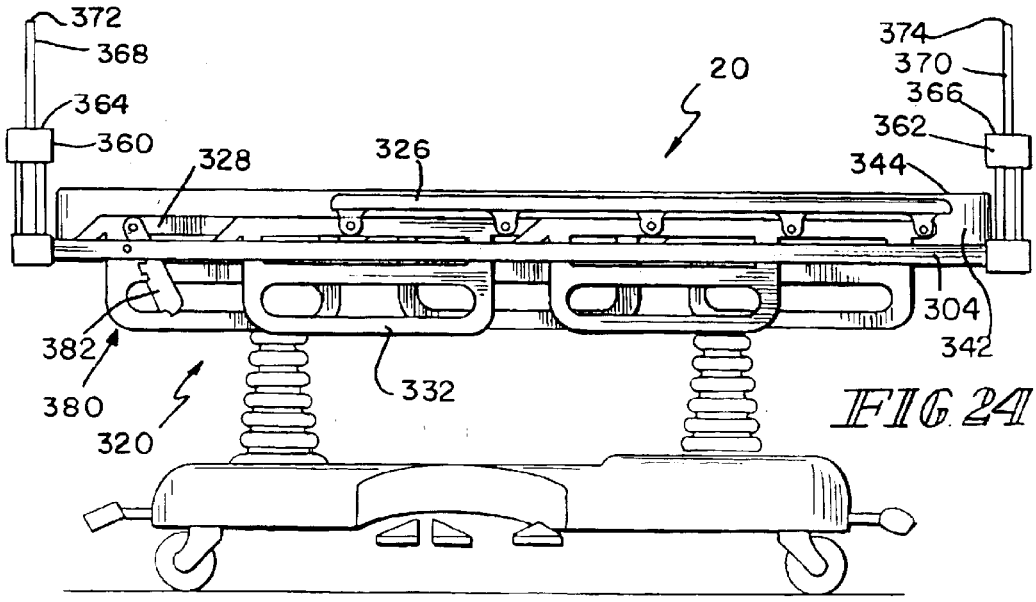
FIG. 24 is a view similar to FIGS. 22 and 23 showing the upright assemblies lowered to a third out-of-the-way down position, where the top rails are generally disposed below the patient support surface.
Figure 24A:
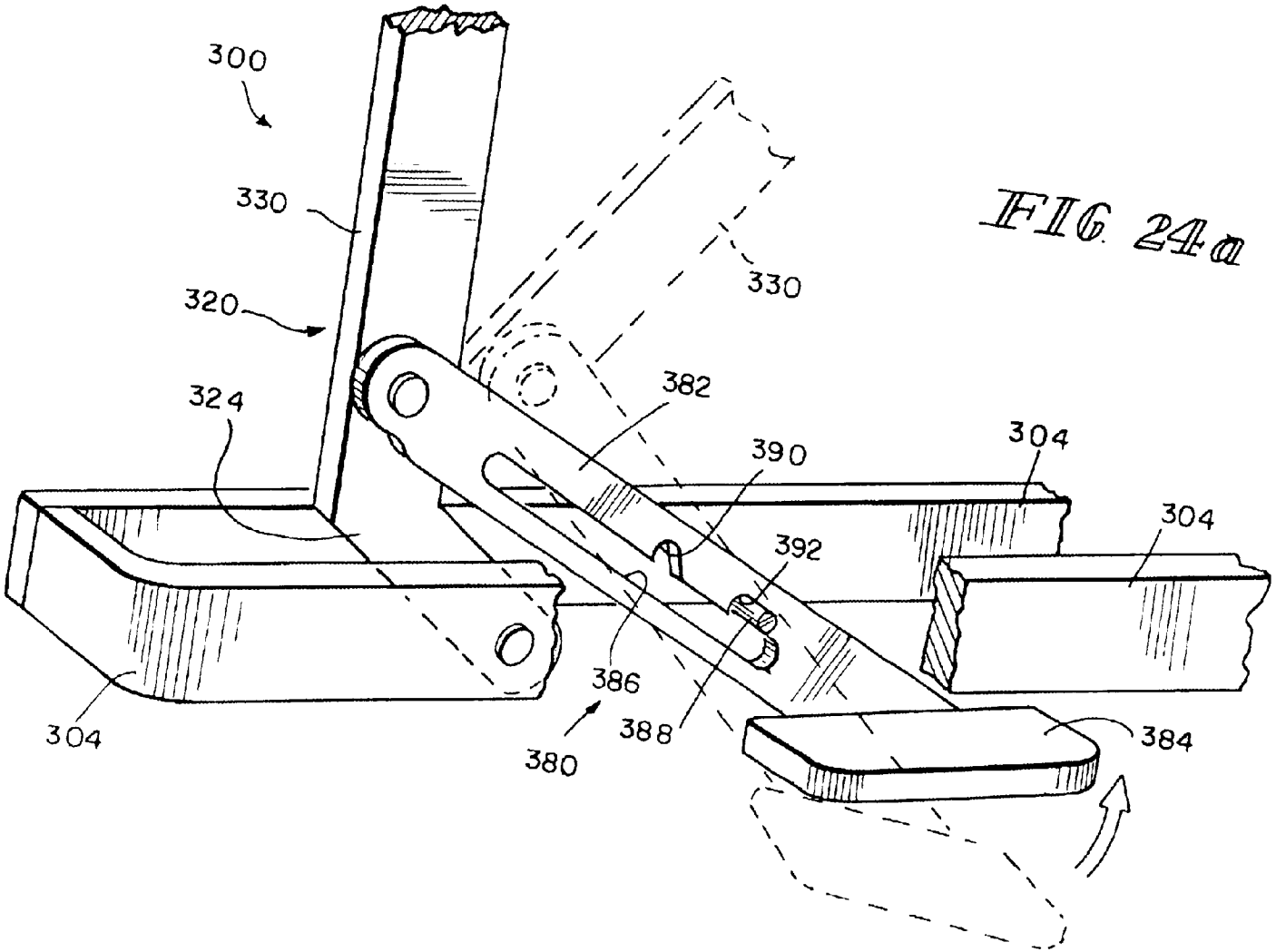
FIG. 24*a* is a perspective view showing a sideframe locking mechanism for locking a collapsible sideframe in one of 3 positions—(i) the first raised position shown in FIG. 22, (ii) the second fully-raised position shown in FIG. 23, and (iii) the third out-of-the-way down position shown in FIG. 24, FIGS. 25 and 26 show a foot section locking mechanism for locking the foot section of the patient support deck in the generally vertical upright position shown in FIG. 23.

Suitable sideframe locking mechanisms 380 are employed, one on each side 306 and 308 of the stretcher 20, to selectively lock the collapsible sideframes 300, 302 in one of the three positions shown in FIGS. 22–24. As shown in FIG. 24*a*, the sideframe locking mechanism 380 on the first side 306 includes a locking bar 382 having a handle portion 384. The locking bar 382 is pivotally coupled to an upright portion 330 of an upright assembly 320 of the collapsible sideframes 300 near the head end thereof. The locking bar 382 includes an elongated slot 386 for slidably receiving a locking pin 388 secured to the intermediate frame 304. The elongated slot 386 includes cutouts 390, 392 for receiving the locking pin 388 to lock the collapsible side frame 300 in the first raised position shown in FIG. 22 (and in dashed lines in FIG. 24*a*), and the second fully-raised position shown in FIG. 23 (and in solid lines in FIG. 24*a*) respectively. The elongated slot 386 may include an additional cutout (not shown) to lock the collapsible side frame 300 in the third out-of-the-way down position shown in FIG. 24. To release the collapsible sideframe 300, the handle portion 384 of the locking bar 382 is lifted to remove the locking pin 388 from a cutout 390, 392 to free the sideframe 300. The sideframe 300 can be then raised or lowered as desired.

Figure 25:
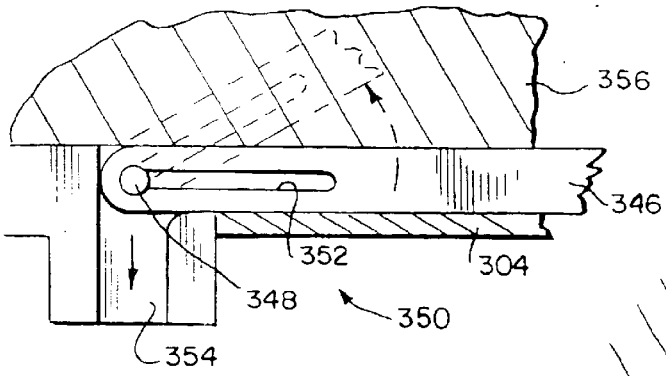
Figure 26:
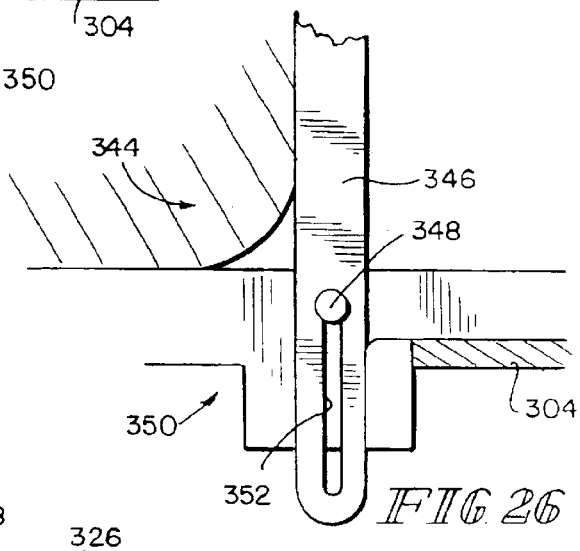
Figure 27:
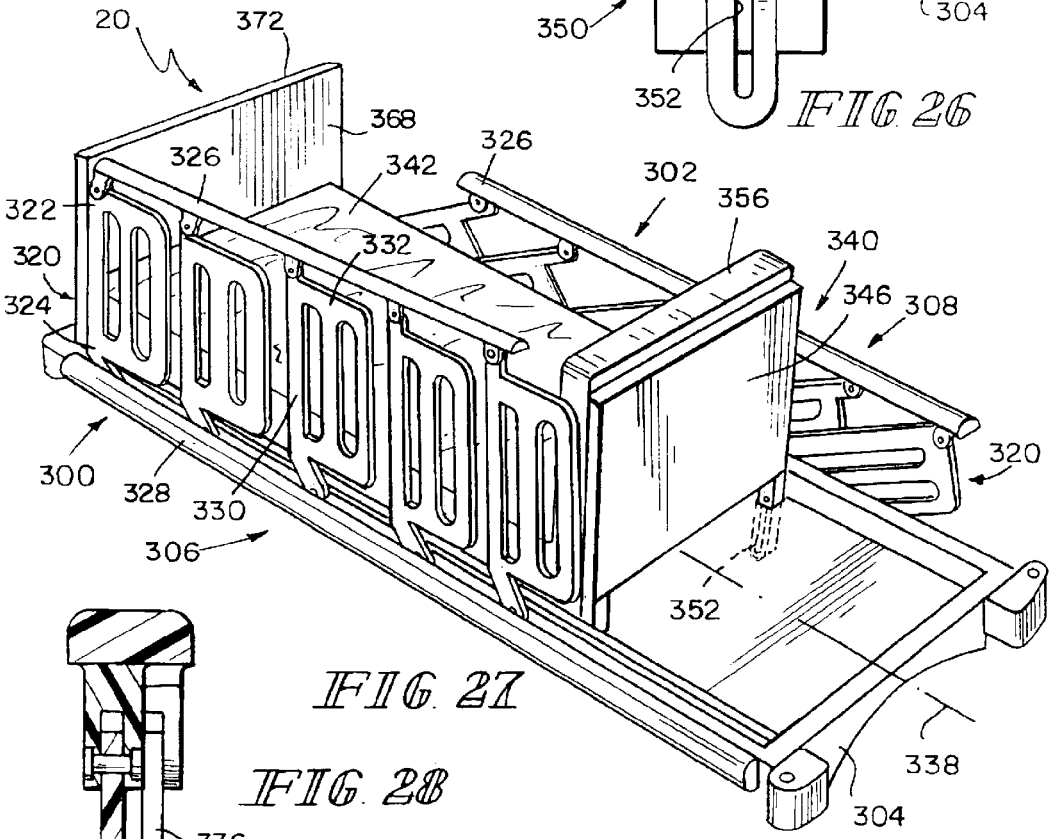
FIG. 27 is a partial perspective view of the hospital stretcher of FIGS. 22–24, showing one collapsible sideframe raised to a first adult patient-restraining raised position, showing the other collapsible sideframe raised to a second pediatric patient-restraining fully-raised position, a headboard also raised to the second pediatric patient-restraining fully-raised position, and further showing a foot section of the patient support deck pivoted upwardly and locked in place to shorten the length of the patient support deck.

A foot section 346 of the upper deck 340 is pivotally coupled to the upper deck 340 about pivot pins 348 for movement between a first generally horizontal position shown in FIGS. 22 and 24, and a second generally vertical position shown in FIG. 23. As shown in FIGS. 25 and 26, a foot section locking mechanism 350 is provided to lock the foot section 346 in the second generally vertical position. The foot section locking mechanism 350 includes (i) a pivot pin-receiving cutout 352 disposed in the foot section 346, which extends generally parallel to the length dimension of the foot section, and (ii) a generally vertically-extending, foot section-receiving compartment 354 provided in the intermediate frame 304. The foot section 346 is pivoted upwardly, and slid downwardly into the foot section-receiving compartment 354 to lock it in place. An associated portion 356 of the mattress 342 is also pivoted upwardly to shorten the length of the articulating upper deck 340 to a length more appropriate for a pediatric patient.

A headboard 360 and a footboard 362 are movably coupled to the intermediate frame 304 adjacent to a head end and a foot end thereof respectively for movement between (i) a first out-of-the-way down position, where the top ends 364 and 366 of the headboard 360 and the footboard 362 are generally disposed below the patient support surface 344, and (ii) a second raised position shown in FIGS. 22–24, where the top ends 364 and 366 of the headboard 360 and the footboard 362 are generally disposed above the patient support surface 344 at an adult patient-restraining height. Pull-out extension panels 368 and 370 are slidably received in the respective compartments in the headboard 360 and footboard 362, respectively. The top ends 372 and 374 of the pull-out extension panels 368 and 370 are disposed above the patient support surface 344 at a pediatric patient-restraining height, as shown in FIGS. 22–24, when the pull-out extension panels are pulled out of the compartments in the headboard 360 and footboard 362, and locked in place while the headboard 360 and the footboard 362 are raised to the second raised position.

Although the invention has been described in detail with reference to certain illustrated embodiments, variations and modifications exist within the scope and spirit of the present invention as described and defined in the following claims.

What is claimed is:

1. A patient support apparatus comprising:

a base, an intermediate frame coupled to the base, a patient support deck coupled to the intermediate frame, the patient support deck having an upwardly-facing patient support surface, a headboard movably coupled to the intermediate frame adjacent to a first end thereof for movement between (i) a first raised position where the top of the headboard is generally disposed above the patient support surface at a first adult patient-restraining height, (ii) a second intermediate position where the top of an extension panel movably coupled to the headboard is generally disposed above the patient support surface at a second pediatric patient-restraining height greater than the first adult patient-restraining height, and (iii) a third out-of-the-way down position where the top of the headboard is generally disposed below the patient support surface, a first headboard locking mechanism coupled to the intermediate frame adjacent the first end thereof for selectively locking the headboard in the first raised position and the second intermediate position, and a second headboard locking mechanism coupled to the headboard for selectively locking the extension panel in a generally vertically extended position where the top of the extension panel is generally disposed above the patient support surface at the second pediatric patient-restraining height.

2. The apparatus of claim 1, further comprising first and second generally vertically-extending rods coupled to the headboard adjacent first and second sides thereof, wherein the first and second generally vertically-extending rods are slidably received in first and second rod-receiving openings disposed in first and second corners of the intermediate frame adjacent the first end thereof to movably support the headboard relative to the intermediate frame.

3. The apparatus of claim 2, wherein the headboard has top and bottom outwardly-extending portions adjacent the first and second sides thereof, wherein the generally vertically-extending rods have top and bottom ends coupled to the top and bottom outwardly-extending portions of the headboard respectively.

4. The apparatus of claim 1, wherein the undersides of the top outwardly-extending portions of the headboard engage the tops ides of the first and second corners of the intermediate frame adjacent the first end thereof to support the headboard in the third out-of-the-way down position.

5. The apparatus of claim 1, wherein the first headboard locking mechanism includes first and second pairs of oppositely-disposed, spring-loaded retaining pins coupled to the headboard adjacent to first and second sides thereof, the first pair of spring-loaded retaining pins being configured to engage first and second corners of the intermediate frame adjacent to the first end thereof to support the headboard in the first raised position, the second pair of spring-loaded retaining pins being configured to engage the first and second corners of the intermediate frame adjacent the first end thereof to support the headboard in the second intermediate position.

6. The apparatus of claim 5, wherein the first headboard locking mechanism includes a headboard release handle movably coupled to the headboard and first and second cables coupling the headboard release handle to the first and second pairs of spring-loaded retaining pins, and wherein the first and second pairs of spring-loaded retaining pins are refracted to release the headboard in response to the movement of the headboard release handle.

7. The apparatus of claim 6, wherein the first headboard locking mechanism includes a plate member coupled to the headboard release handle, the plate member having first and second portions configured for engaging the first and second cables in response to the movement of the headboard release handle to refract the first and second pairs of spring-loaded retaining pins to free the headboard.

8. The apparatus of claim 1, wherein the extension panel is pivotally coupled to the headboard for movement between a first out-of-the-way down position and a second generally vertically extended position, the extension panel being dimensioned such that the top of the extension panel is disposed above the patient support surface at the second pediatric patient-restraining height when the extension panel is disposed in the second generally vertically extended position while the headboard is disposed in the second intermediate position.

9. The apparatus of claim 8, wherein the second headboard locking mechanism comprises a spring-loaded locking pin coupled to the extension panel, wherein the spring-loaded locking pin is configured to enter a first pin-receiving receptacle in the headboard when the extension panel is in the first out-of-the-way down position to lock the extension panel in the first out-of-the-way down position.

10. The apparatus of claim 9, wherein the second headboard locking mechanism further comprises a spring-loaded button movably coupled to the headboard, the spring-loaded button having a first finger extending into the first pin-receiving receptacle in the headboard, the first finger being configured to push the spring-loaded locking pin out of the first pin-receiving receptacle when the extension panel is in the first out-of-the-way down position to free the extension panel upon actuation of the spring-loaded button.

11. The apparatus of claim 10, wherein the spring-loaded locking pin coupled to the extension panel is configured to enter a second pin-receiving receptacle in the headboard when the extension panel is in the second generally vertically extended position to lock the extension panel in the second generally vertically extended position.

12. The apparatus of claim 11, wherein the spring-loaded button includes a second finger extending into the second pin-receiving receptacle in the headboard, the second finger being configured to push the spring-loaded locking pin out of the second pin-receiving receptacle when the extension panel is in the second generally vertically extended position to free the extension panel upon actuation of the spring-loaded button.

13. The apparatus of claim 12, wherein the spring-loaded locking pin coupled to the extension panel is configured to enter a third pin-receiving receptacle in the headboard when the extension panel is in a third generally horizontal shelf position extending over the patient support surface to lock the extension panel in the third generally horizontal shelf position.

14. The apparatus of claim 13, wherein the spring-loaded button has a third finger extending into the third pin-receiving receptacle in the headboard, the third finger portion being configured to push the spring-loaded locking pin out of the third pin-receiving receptacle when the extension panel is in the third generally horizontal shelf position to free the extension panel upon actuation of the spring-loaded button.

* * * * *